US007703706B2

(12) United States Patent
Walker

(10) Patent No.: US 7,703,706 B2
(45) Date of Patent: Apr. 27, 2010

(54) VARIABLE ARC NOZZLE

(75) Inventor: Samuel C. Walker, Green Valley, AZ (US)

(73) Assignee: Rain Bird Corporation, Azusa, CA (US)

( * ) Notice: Subject to any disclaimer, the term of this patent is extended or adjusted under 35 U.S.C. 154(b) by 548 days.

(21) Appl. No.: 11/622,772

(22) Filed: Jan. 12, 2007

(65) Prior Publication Data

US 2008/0169363 A1 Jul. 17, 2008

(51) Int. Cl.
*B05B 1/32* (2006.01)
*B05B 1/34* (2006.01)
*B05B 1/26* (2006.01)

(52) U.S. Cl. ..... 239/501; 239/458; 239/461; 239/487; 239/505; 239/DIG. 1

(58) Field of Classification Search ..... 239/97, 239/98, 451, 452, 456, 457, 458, 460, 214.11, 239/218.5, 222.11, 246, 461, 484, 487, 501, 239/505, 518, DIG. 1
See application file for complete search history.

(56) References Cited

U.S. PATENT DOCUMENTS 2,723,879 A 11/1955 Martin
3,940,066 A 2/1976 Hunter
4,131,234 A 12/1978 Pescetto
4,189,099 A 2/1980 Bruninga
4,471,908 A 9/1984 Hunter
4,579,285 A * 4/1986 Hunter ..... 239/457
4,625,917 A 12/1986 Torney
4,739,934 A 4/1988 Gewelber
D296,464 S 6/1988 Marmol et al.
4,752,031 A 6/1988 Merrick
4,898,332 A 2/1990 Hunter et al.
5,031,840 A 7/1991 Grundy et al.
5,050,800 A 9/1991 Lamar
5,058,806 A 10/1991 Rupar
5,148,990 A 9/1992 Kah, Jr.
5,205,491 A * 4/1993 Hadar ..... 239/457
5,267,689 A 12/1993 Forer
5,288,022 A 2/1994 Sesser
5,322,223 A 6/1994 Hadar (Continued)

FOREIGN PATENT DOCUMENTS

EP 0724913 A2 7/1996

(Continued)

*Primary Examiner*—Dinh Q Nguyen
*Assistant Examiner*—Ryan Reis
(74) *Attorney, Agent, or Firm*—Fitch, Even, Tabin & Flannery

(57) ABSTRACT

A variable arc sprinkler nozzle is provided for distribution of water through nearly any adjustable arcuate span. The nozzle includes one or more arcuate slots formed by the helical engagement of spiral surfaces of a deflector and a nozzle body. A user may rotate a portion of the nozzle body to select the arcuate span of the one or more slots. A matched precipitation rate feature is adjustable to proportion the amount of water directed to the deflector depending on the extent of the arcuate span. Further, edge fins on the deflector and nozzle body channel water flow at the two edges of the distribution arc to increase the throw radius and to provide fairly uniform water distribution at the edges of the arc.

35 Claims, 16 Drawing Sheets

U.S. PATENT DOCUMENTS

| | | | | |
|---|---|---|---|---|
| 5,556,036 | A | 9/1996 | Chase | |
| 5,588,594 | A | 12/1996 | Kah, Jr. | |
| 5,642,861 | A | 7/1997 | Ogi et al. | |
| 5,718,381 | A | 2/1998 | Katzer et al. | |
| 5,845,849 | A | 12/1998 | Mitzlaff | |
| 6,019,295 | A * | 2/2000 | McKenzie | 239/451 |
| 6,145,758 | A * | 11/2000 | Ogi et al. | 239/457 |
| 6,158,675 | A | 12/2000 | Ogi | |
| 6,244,521 | B1 | 6/2001 | Sesser | |
| 6,264,117 | B1 * | 7/2001 | Roman | 239/203 |
| 6,443,372 | B1 * | 9/2002 | Hsu | 239/457 |
| 6,464,151 | B1 | 10/2002 | Cordua | |
| 6,499,672 | B1 | 12/2002 | Sesser | |
| 6,637,672 | B2 | 10/2003 | Cordua | |
| 6,651,905 | B2 | 11/2003 | Sesser et al. | |
| 6,736,332 | B2 | 5/2004 | Sesser et al. | |
| 6,769,633 | B1 | 8/2004 | Huang | |
| 6,814,304 | B2 | 11/2004 | Onofrio | |
| 6,834,816 | B2 | 12/2004 | Kah, Jr. | |
| 6,883,727 | B2 | 4/2005 | De Los Santos | |
| 7,032,836 | B2 | 4/2006 | Sesser et al. | |
| 7,032,844 | B2 | 4/2006 | Cordua | |
| 7,152,814 | B1 | 12/2006 | Schapper et al. | |
| 7,156,322 | B1 | 1/2007 | Heitzman | |
| 7,159,795 | B2 | 1/2007 | Sesser et al. | |
| 7,168,634 | B2 | 1/2007 | Onofrio | |
| 7,232,081 | B2 | 6/2007 | Kah, Jr. et al. | |
| 7,234,651 | B2 * | 6/2007 | Mousavi et al. | 239/201 |
| RE40,440 | E | 7/2008 | Sesser | |
| 2002/0130202 | A1 | 9/2002 | Kah, Jr. et al. | |
| 2002/0153434 | A1 | 10/2002 | Cordua | |
| 2003/0015606 | A1 | 1/2003 | Cordua | |
| 2005/0161534 | A1 | 7/2005 | Kah, Jr. et al. | |
| 2007/0235565 | A1 | 10/2007 | Kah, Jr. et al. | |
| 2008/0169363 | A1 | 7/2008 | Walker | |

FOREIGN PATENT DOCUMENTS

| | | | |
|---|---|---|---|
| EP | 0761312 | A1 | 12/1997 |
| EP | 1043075 | A1 | 11/2000 |
| WO | WO9735668 | | 10/1997 |
| WO | WO2005099905 | | 10/2005 |

* cited by examiner

VARIABLE ARC NOZZLE

FIELD OF THE INVENTION

This invention relates to irrigation sprinklers, and, more particularly, to sprinklers having a variable arc nozzle for adjusting the arcuate span of water distribution.

BACKGROUND OF THE INVENTION

The use of sprinklers is a common method of irrigating areas of grass, trees, flowers, crops, and other types of vegetation. In a typical irrigation system, many different types of sprinklers may be used to distribute water over a desired area. One type of irrigation sprinkler that is commonly used is a spray head sprinkler having a nozzle that produces a fan-shaped spray projected outwardly in an arcuate pattern about the sprinkler. Typically, such spray heads are mounted on either stationary risers or on pop-up risers that are movably mounted in a housing buried in the ground. In case of a pop-up riser, the riser is retracted into the housing when the sprinkler is not in operation and extends out of the housing and above the ground when the sprinkler is in operation. There are several concerns, however, that arise when using such variable arc spray nozzles: (1) insufficient adjustability of the arcuate span of the water distribution; (2) insufficient water distribution to terrain relatively close to the sprinkler; (3) lack of a uniform water precipitation rate between arcs of different spans; and (4) lack of uniform water distribution at the edges of the distribution pattern.

First, in many instances, it is desirable to control the arcuate area over which the sprinkler distributes water. In this regard, it is often desirable to use a spray nozzle that distributes water through a variable pattern in virtually infinite arcuate settings between a full circle pattern and a very small arcuate pattern of about 5° or less.

Second, it is desirable to have a portion of the spray distributed close in to the sprinkler to avoid producing a donut-shaped watering pattern about the sprinkler. Many commercially available variable arc spray nozzles tend to distribute water in a donut-shaped pattern with little water being distributed in the region close to the sprinkler. Thus, regions that are further from the sprinkler generally receive more water than regions that are closer to the sprinkler. Accordingly, there is a need for a variable arc nozzle that provides a water distribution pattern that includes appropriate watering near the sprinkler.

Third, variable arc nozzles often generate different precipitation rates, depending on the size of the arcuate span of water distribution selected by the user. Generally, smaller arc settings tend to result in higher precipitation rates because a given amount of water is distributed over a smaller area. For example, when the size of the arc is reduced (such as from full circle to half circle), if the flow rate is not also reduced, the resulting precipitation rate will be relatively high for the reduced area of coverage. In most instances, it is highly desirable that each sprinkler in the system provide a uniform amount of water to the selected watering area so that all vegetation receives the same amount of water over a given time regardless of the arcuate span of the water distribution. Thus, there is a need for a variable arc nozzle that proportionally adjusts the flow rate through the nozzle as the arcuate span of the water distribution is adjusted by the user.

Typically, the water precipitation rate of conventional spray head sprinklers is generally not homogenous along the radius of distribution. The water precipitation rate depends on the square of the distance from the sprinkler. Accordingly, in many instances, the flow rates of nozzles are specifically set by the manufacturer to different amounts depending on the radius of coverage of the nozzle. The flow rates of nozzles designed for closer ranges of coverage, such as four, six, or eight feet, are therefore less than that for nozzles designed for more distant ranges of coverage, such as ten, twelve, or fifteen feet.

One method of decreasing flow rate is by the use of arcuate water outlet spray slots that are relatively narrow, e.g., on the order of 0.02 inches. The use of these relatively narrow slots is especially common for fan spray nozzles intended to provide a relatively close range of coverage, such as four, six, or eight feet. These narrow slots, however, are easily clogged by dirt or other debris. Thus, there is a need for variable arc nozzles that proportionally adjust the flow rate through the nozzle to avoid using narrow arcuate outlet slots that can become clogged.

Fourth, there is a need to improve the water definition and evenness at the edges of the water distribution arc. There are often irregularities and gaps at the edges of the arc. For example, while water in the central part of an arc distribution pattern is generally thrown a uniform distance from the nozzle, the water at the edges of the arc is not thrown as far. Also, even for terrain along the edges relatively close to the nozzle, there is uneven water distribution. Where multiple sprinklers are used to cover a given terrain, this unevenness at the edges results in gaps of coverage and non-uniform coverage, especially at the transition areas from one sprinkler's coverage to another and at areas close to the individual sprinklers.

The irregularities and gaps at the edges result from components of the variable arc nozzle known as edge "fins," which are used to define the size of the water distribution arc. The gaps and irregularities at the edges of the water distribution arc generally arise from three factors associated with these edge fins. First, the fins generate frictional drag against water distributed at the edges of the pattern that is not present at the center of the pattern where there are no fins. This drag, in turn, reduces the throw distance of water at the edges of the arc distribution pattern. Second, there is a significant tangential component of water flow at the edge fins. Some of the tangential flow results from leakage between mating components of the nozzle, causing deflection of a portion of the outwardly projected flow and resulting in gaps and uneven water distribution. Third, conventional edge fins do not sufficiently channel the outwardly projected flow along the edges of the arc, again resulting in a tangential component of flow and uneven water distribution.

Accordingly, it is desirable to have a variable arc nozzle that: (1) adjusts to about any desired arcuate span of water distribution; (2) provides increased water distribution to terrain near the sprinkler; (3) provides a relatively constant water precipitation rate regardless of the size of the arcuate span of water distribution selected by the user; and (4) provides a water distribution arc with fairly even water distribution at the edges of the arc. Depending on the specific needs of the user, it may be desirable to incorporate one or more of the above features into a given variable arc nozzle. The present invention fulfills these needs and provides further related advantages.

DESCRIPTION OF THE PREFERRED EMBODIMENTS

Figure 1:
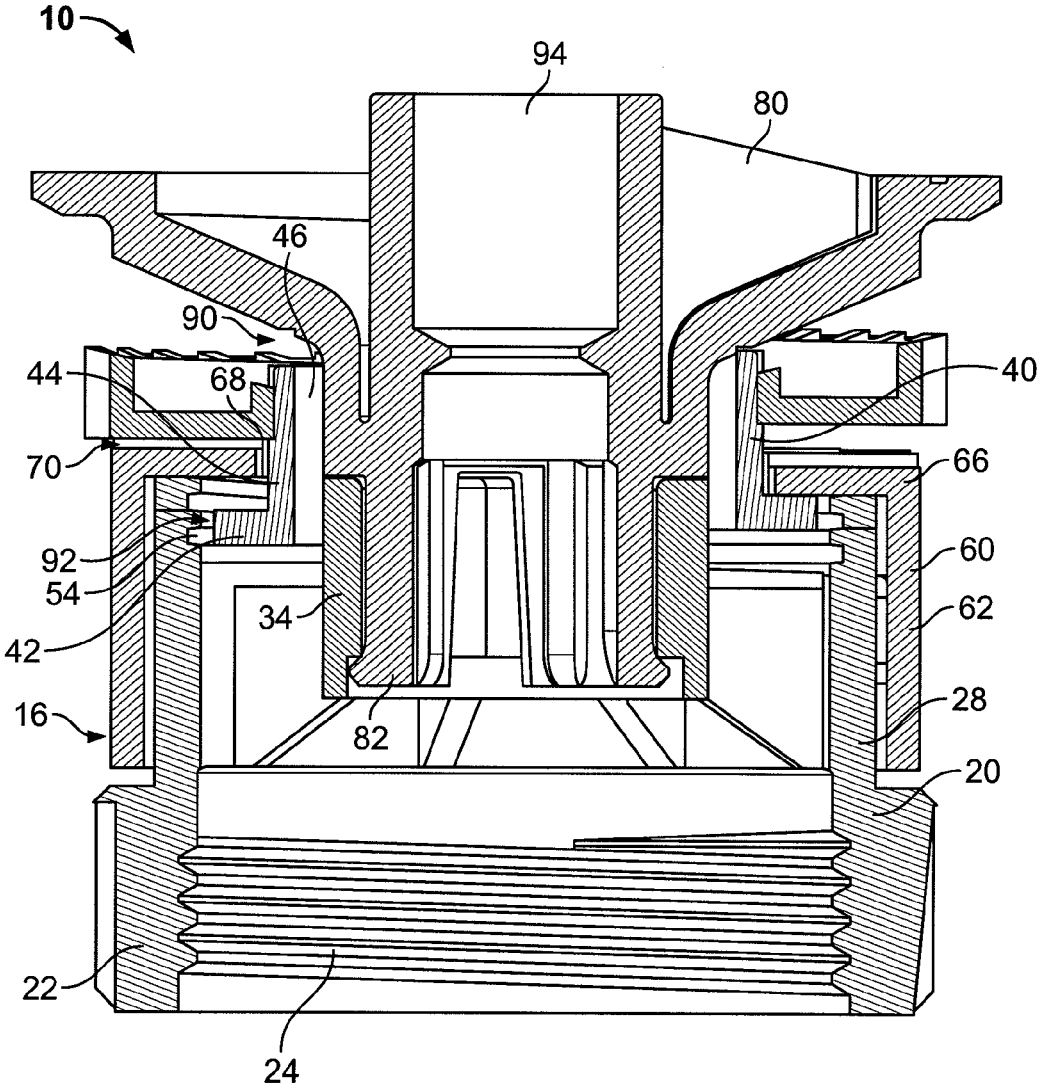
FIG. 1 is a cross-sectional view of a first embodiment of a variable arc nozzle embodying features of the present invention to provide increased water distribution near the nozzle.

FIGS. 1-17 illustrate five preferred embodiments of an improved variable arc nozzle that may be adjusted to virtually any arcuate span of water distribution that may be desired for irrigation. The first and second embodiments also illustrate a nozzle providing improved close-in watering of terrain near the nozzle (FIGS. 1-7). The third and fourth embodiments show a nozzle providing a relatively constant water precipitation rate regardless of the arcuate span of the water distribution (FIGS. 8-12). The fifth embodiment illustrates a nozzle providing improved water distribution at the edges of the water distribution arc (FIGS. 13-17).

With reference to FIGS. 1-5, the first embodiment of a variable arc nozzle 10 generally comprises a spray head nozzle unit or head having a body 16 adapted for convenient thread-on mounting onto the upper end of a stationary or pop-up tubular riser (not shown). The nozzle 10 defines an upper arcuate slot 90 and a lower arcuate slot 92. In operation, water under pressure is delivered through the riser to the nozzle body 16 and discharged from the body through the upper arcuate slot 90 and the lower arcuate slot 92 for irrigation. The arcuate extent of the two arcuate slots 90 and 92 is readily adjustable from anywhere between 0° (off) to 360° (fully open). The lower slot 92 generally provides close in watering near the nozzle 10, and the upper slot 90 provides water for the water pattern beyond the close in area.

More specifically, the variable arc nozzle 10 includes several components with complementary surfaces in the shape of a 360 degree spiral, or helical turn or revolution, with axially offset ends. These complementary surfaces cooperate to form the upper and lower arcuate slots 90 and 92 with the same arcuate span of water distribution and which can be adjusted to virtually any arcuate span desired for irrigation. The upper arcuate slot 90 emits water from a primary outlet for watering a vast majority of the distribution pattern which is beyond that watered by the lower slot 92. The lower arcuate slot 92 emits the water from a secondary outlet for watering an area relatively close to the nozzle 10. The upper and lower arcuate slots 90 and 92 lie in the path of a first and second flow path, respectively.

Figure 2:
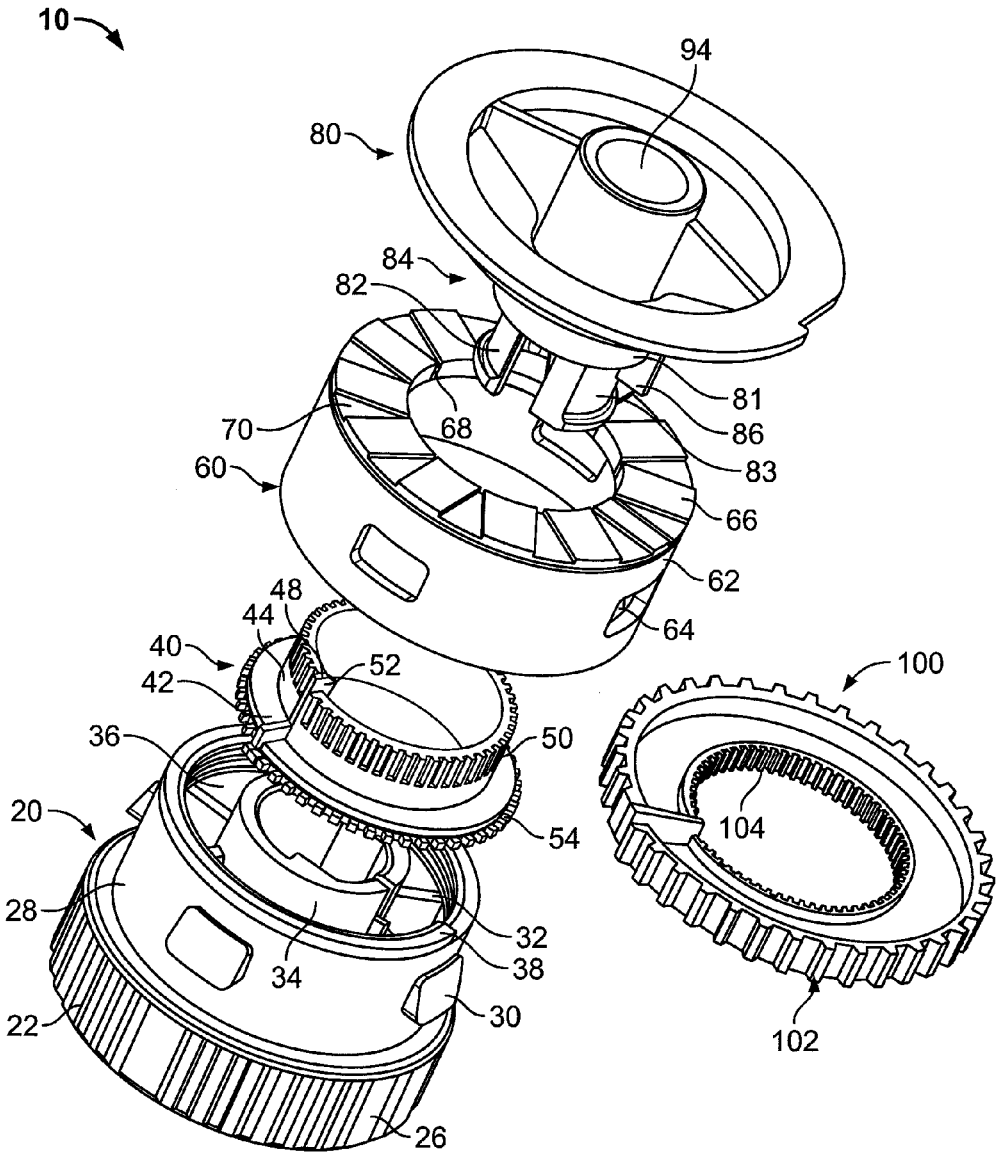
FIG. 2 is an exploded perspective view of the variable arc nozzle of FIG. 1.

As shown in FIG. 2, the components providing the complementary surfaces include a base 20, a collar 40, a cover 60, and a deflector 80. Each of these components preferably have complementary spiral-like surfaces, i.e., surfaces generally in the shape of a single 360 degree helical turn or revolution with axially offset ends, that cooperate with one another to form the upper and lower arcuate slots 90 and 92. The upper arcuate slot 90 is formed by the helical engagement of the collar 40 and the deflector 80 and lies within the first water flow path. The lower arcuate slot 92 is formed by the helical engagement of the collar 40 and the cover 60 and lies within the second water flow path. The nature of the components and the operation of the nozzle 10 are set forth more fully below.

The base 20 has a generally cylindrical shape with a lower end 22 having internal threading 24 for quick and easy thread-on mounting onto an upper end of a riser having complementary exterior threading (not shown). The lower end 22 also has a grippable external surface 26 (such as a series of vertically extending ribs) to assist in holding and turning the base 20 for mounting onto the riser. An outer wall 28 extends upward from the lower end 22 of the base 20. The outer wall 28 has several locking tabs 30, protruding outwardly therefrom. The four tabs 30 are preferably spaced equidistantly about the perimeter of the outer wall 28. The tabs 30 interlockably engage the cover 60 to attach the cover 60 to the base 20.

Figure 3:
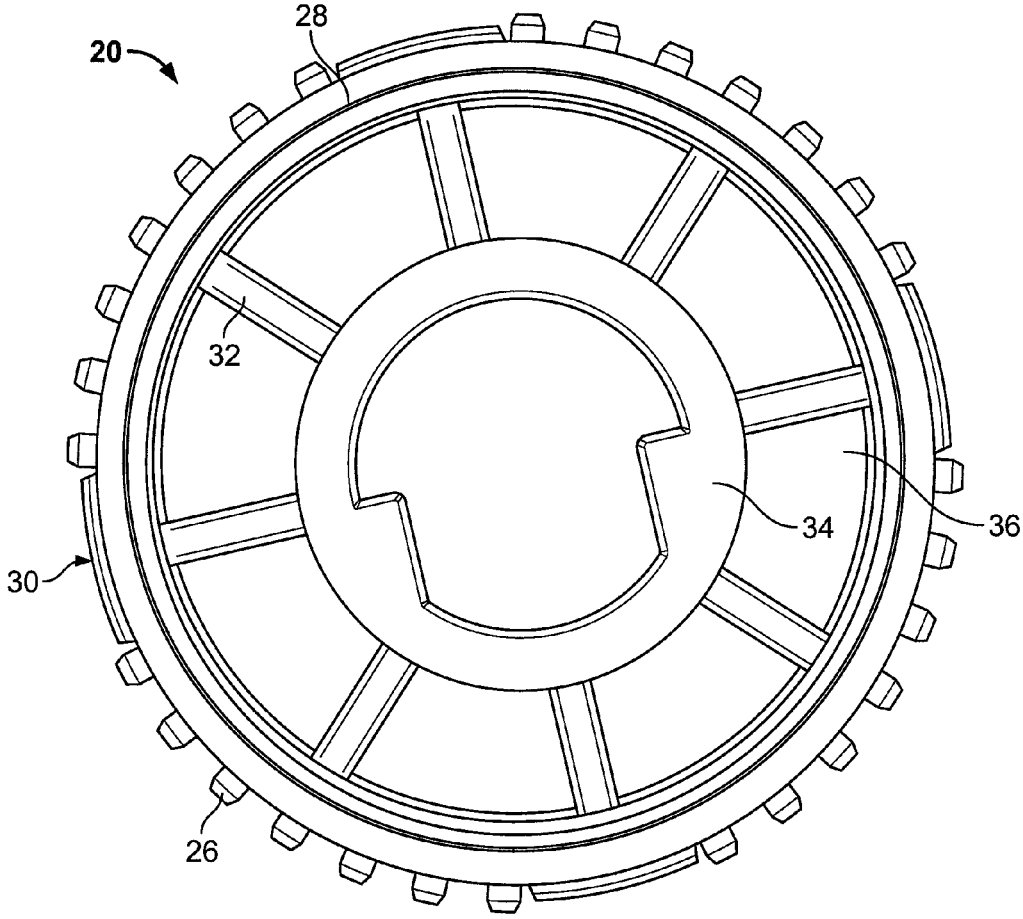
FIG. 3 is a top plan view of the base of the variable arc nozzle of FIG. 1.

As shown in FIGS. 2 and 3, the base 20 includes a set of spoke-like ribs 32 that interconnect the outer wall 28 to a central hub 34. The ribs 32 define flow passages 36 that permit water flow through the base 20 and into the collar 40. The upper edge 38 of the outer wall 28 defines a spiral, or helical turn or revolution, with axially offset ends for engagement with the collar 40.

The collar 40 includes a radially extending, ring-like flange 42 that also has a spiral or helical turn or revolution configuration, with axially offset ends. The flange 42 preferably sits between complementary portions of the base 20 and the cover 60. More specifically, the flange 42 sits atop the edge 38 of the base 20 and underneath a spiral surface of the cover 60, as described below. The collar 40 also includes a central hub 44, which extends upwardly from the inner circular edge of the flange 42. The central hub 44 has an upper edge 48 in the shape of a spiral, or helical turn or revolution, that engages a complementary spiral surface on the underside of the deflector 80, as described below.

Figure 4:
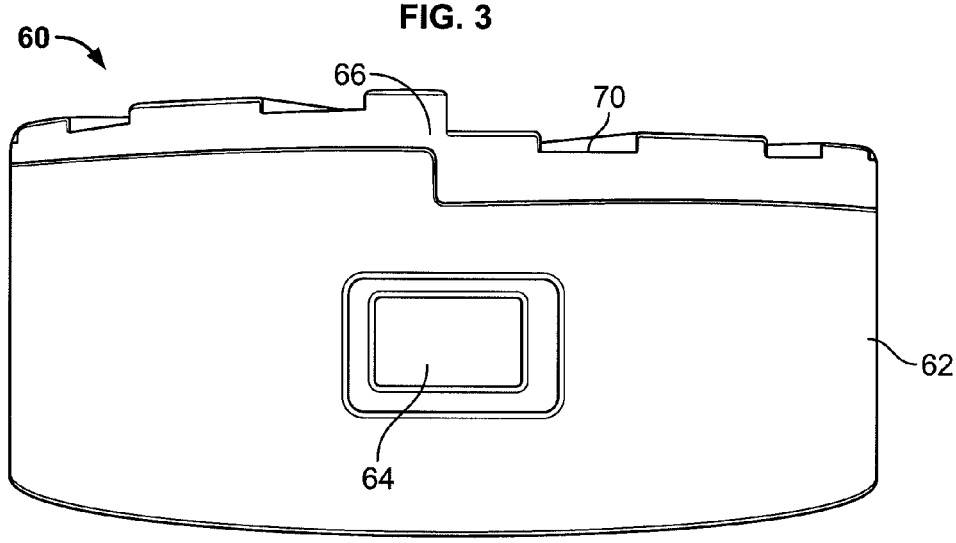
FIG. 4 is a front elevational view of the cover of the variable arc nozzle of FIG. 1.

With reference to FIGS. 2 and 4, the cover 60 has an outer wall 62 defining a number of apertures 64. There are preferably four apertures 64 to each receive one of the tabs 30 to interlock the cover 60 with the base 20. As should be evident, other ways may be used to fasten the cover 60 to the base 20, such as a threaded engagement or by sonic welding.

The cover 60 also preferably includes a ring-like central hub 66 that defines a spiral, or a helical turn or revolution. When the base 20 and cover 60 are interlockably engaged, the complementary spiral edge 38 surfaces of the base 20, the flange 42 of the collar 40, and underside surface of the cover 60 are stacked vertically one atop another (FIG. 1). More specifically, the underside of the ring-like central hub 66 of the cover 60 preferably sits vertically atop the ring-like flange 42 of the collar 40, which, in turn, sits vertically atop the spiral upper edge 38 of the base 20.

Figure 5:
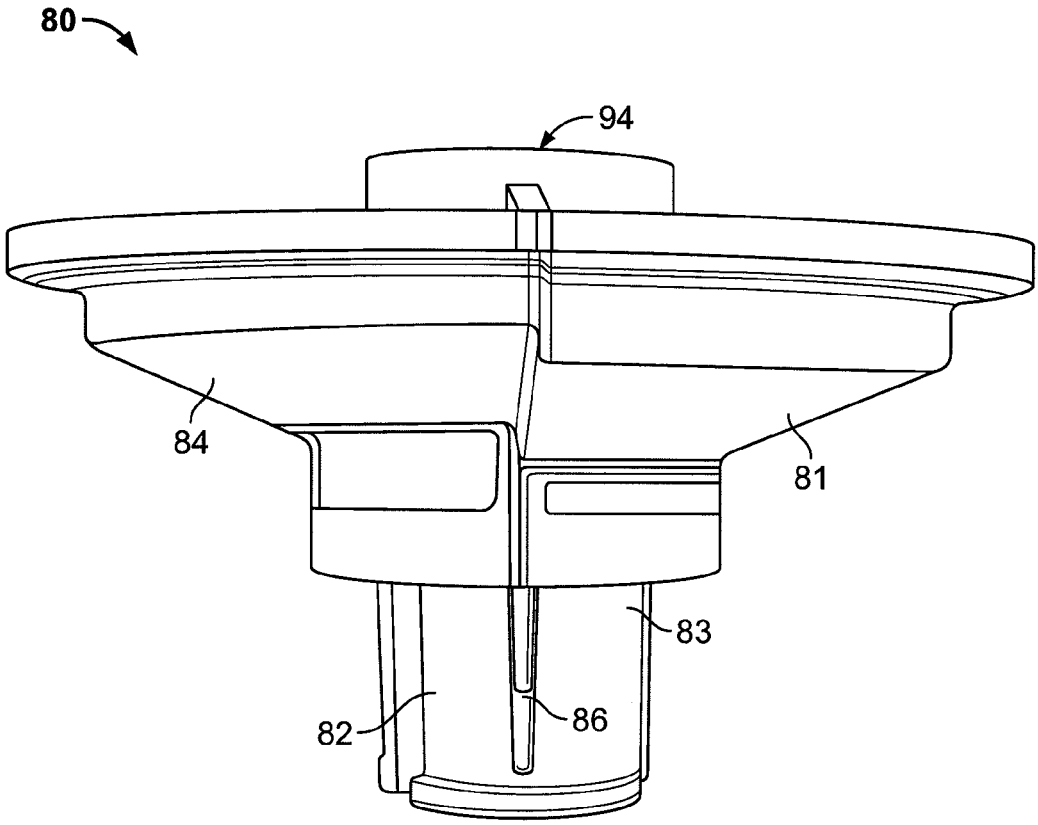
FIG. 5 is a front elevational view of the deflector of the variable arc nozzle of FIG. 1.

With reference to FIGS. 2 and 5, the deflector 80 has a generally frusto-conical shape with an enlarged head portion 81 for deflecting and redirecting water and a lower stem portion 83 divided into two-prongs 82. The underside 84 of the head portion 81 of the deflector 80 defines a spiral, or helical turn or revolution. During assembly, the lower end of the stem portion 83 is inserted through the central hubs 34, 44, and 66 of the base 20, collar 40, and cover 60, respectively. The prongs 82 of the lower end of the stem portion 83 lock with the central hub 34 of the base 20 (FIG. 1). The cover 60 also is fixed with respect to the base 20 and the deflector 80 through the tabs 30 and apertures 64, as described above. The collar 40, however, is rotatable with respect to the base 20, the cover 60, and the deflector 80. Rotation of the collar 40 allows the arcuate extent of the slots 90 and 92 to be either increased or decreased to thereby control the desired arcuate span of water distribution.

Rotation of the collar 40 is preferably controlled through the use of an adjustment ring 100. The adjustment ring 100 has a knurled external surface 102 for gripping and a splined internal surface 104 for operatively engaging the collar 40. More specifically, the splined internal surface 104 interlockably engages a corresponding splined surface 50 on the central hub 44 of the collar 40. Rotation of the adjustment ring 100 therefore causes corresponding rotation of the collar 40. The adjustment ring 100 is rotatable through approximately one revolution and controls the arcuate extent of the upper and lower slots 90 and 92, which extent is preferably the same for both distant watering and close in watering.

In operation, water entering the nozzle 10 flows along a first flow path and a second flow path. The first flow path supplies water to the upper arcuate slot 90 for the distribution of water to terrain relatively distant from the nozzle 10, while the second flow path supplies water to the lower arcuate slot 92 for the distribution of water to terrain relatively close to the nozzle 10.

In the first flow path, pressurized supply water travels through the flow passages 36 of the base 20 and then flows through a flow conduit externally bounded by the central hub 44 of the collar 40 and internally bounded by the lower stem portion 83 of the deflector 80, as shown in FIG. 1. After traveling through this flow conduit, the water flows through the upper arcuate slot 90 and impacts the underside 84 of the deflector 80. The deflector 80 redirects the water upwardly and outwardly to the desired terrain at a predetermined distance about the nozzle 10.

The spiral upper edge 48 of the collar 40 and the spiral underside surface 84 of the deflector 80 engage one another to define the arcuate extent of the upper slot 90, which determines the arcuate span of the water distribution. More specifically, the arcuate span of water distribution is determined by the position of the upper helical edge 48 of the collar 40 relative to the complementary helical underside surface 84 of the deflector 80. For example, as shown in FIG. 1, the upper slot 90 is open on the left and closed on the right. The collar 40 may be rotated relative to the deflector 80 any arbitrary amount to expand or decrease the size of the arcuate slot 90. Thus, the size of the slot 90 is not limited to discrete arcs, such as a quarter-circle and a half-circle.

When the nozzle 10 is set to be totally shut off, the spiral edge 48 of the collar 40 and the complementary spiral underside surface 84 of the deflector 80 engage one another all the way around so that there is no arcuate slot 90 and the first flow path is therefore obstructed. As the collar 40 is then rotated in the clockwise direction through use of the adjustment ring 100, the upper spiral edge 48 of the collar 40 begins to traverse the helical underside surface 84 of the deflector 80. As it begins to traverse the helical turn, the collar 40 becomes spaced from the deflector 80 and the upper arcuate slot 90 begins to form between the collar 40 and the deflector 80. The arcuate extent of the upper slot 90 increases as the adjustment ring 100 is further rotated clockwise to cause the collar 40 to continue to traverse the helical turn. The adjustment ring 100 may be rotated clockwise until a stop 52 on the collar 40 engages a stop 86 on the deflector 80, preventing further rotation. At this point, the collar 40 has traversed the entire helical turn and the arcuate extent of the upper slot 90 is nearly 360 degrees. In this fully open position, water is distributed in essentially a full circle about the nozzle 10.

When the collar 40 is rotated counterclockwise through use of the adjustment ring 100, the arcuate extent of the upper slot 90 is decreased. The upper spiral edge 48 of the collar 40 traverses the helical turn in the opposition direction, progressively reducing the size of the upper slot 90. When the upper spiral edge 48 has traversed the helical turn completely, the stop 52 of the collar 40 engages the stop 86 of the deflector 80 and prevents further rotation. At this point, the upper slot 90 is closed and the first flow path through the collar 40 is again obstructed against further flow.

In the second flow path, pressurized supply water travels through the flow passages 36 of the base 20 and then flows through the lower arcuate slot 92, which is formed by the engagement of the collar 40 with the cover 60, as described more fully below. Prior to flowing through the lower arcuate slot 92, water is preferably filtered by radially extending teeth 54, preferably about 0.01 inches in length, spaced circumferentially along the outer perimeter of the ring-like flange 42 of the collar 40, as shown in FIG. 2.

The spiral flange 42 of the collar 40 and the spiral underside surface of the cover 60 engage one another to form the lower arcuate slot 92. More specifically, the spiral ring-like flange 42 of the collar 40 engages the underside of the spiral central hub 66 of the cover 60. The interaction between these two opens and closes the lower arcuate slot 92. For example, as shown in FIG. 1, the lower slot 92 is open on the left and closed on the right. The arcuate extent of the lower slot 92 adjusts with the arcuate extent adjustment of the upper arcuate slot 90 by rotation of the collar 40 through the adjustment ring 100.

The spiral surfaces of the collar 40, cover 60, and deflector 80 are preferably aligned so that the angle of the lower arcuate slot 92 is the same as the angle of the upper arcuate slot 90. Thus, rotation of the collar 40 through use of the adjustment ring 100 will preferably result in the same arcuate span of water distribution for both distant and close in watering.

The closing and opening of the lower arcuate slot 92 is similar in operation to that of the upper arcuate slot 90. When in the closed position, the complementary spiral surfaces of the collar 40 and the cover 60 engage one another to obstruct the second flow path. As the collar 40 is rotated in the clockwise direction through use of adjustment ring 100, the ring-like flange 42 of the collar 40 traverses the underside of central hub 66 of the cover 60. As it begins to traverse the helical turn, the collar 40 becomes spaced from the cover 60 and the lower arcuate slot 92 begins to form between the collar 40 and the deflector 80. The adjustment ring 100 may be rotated until stop 52 on the collar 40 engages stop 86 on the deflector 80, preventing further rotation with respect to both the upper and lower arcuate slots 90 and 92. In this position, both the upper and lower arcuate slots 90 and 92 are fully open and distribute water in a full circle to terrain distant from and close to the nozzle 10, respectively. Rotation of the adjustment ring 100 in the counterclockwise direction results in the closing of the lower arcuate slot 92.

After the water flows through the lower arcuate slot 92, it is redirected generally vertically through one or more grooves 68 spaced along the inside circumference of the cover 60. The cover 60, shown in FIGS. 2 and 4, preferably contains twelve such grooves 68 spaced every 30 degrees. Thus, if the lower arcuate slot 92 is open about 90 degrees, water flowing through the lower arcuate slot 92 will be redirected through three grooves 68.

Water flowing through the grooves 68 impacts and is redirected by the underside surface of the adjustment ring 100. The adjustment ring 100 redirects the water radially outward through the triangular flow passages 70 spaced circumferentially about the central hub 66 of the cover 60. The cover 60 preferably contains twelve such triangular flow passages 70 spaced every 30 degrees about the central hub 66, so if the lower arcuate slot 92 is open about 90 degrees, water flowing through the slot 92 will be redirected through three flow passages 70. Given the angle of impact with the cover 60 and adjustment ring 100, the redirection of water flow, and the widening of the triangular flow passages 70, a portion of the water velocity and energy in the second flow path will be dissipated, and the water exiting the triangular flow passages 70 will be distributed to terrain relatively close to the nozzle 10.

The nozzle 10 also preferably includes a bore 94, which accommodates an adjustment screw 196 (shown in FIG. 6 for the second embodiment), or comparable adjustment member. The bore 94 extends through the deflector 80 to a flow adjustment collar, or similar flow rate adjustment device, located below the base 20. One such flow adjustment collar is shown in U.S. Pat. No. 6,814,304, assigned to the assignee of the present invention, which disclosure is incorporated herein by reference. The adjustment screw 196 can be used to selectively set the throw radius of the nozzle 10. Adjustment of the throw radius through use of an adjustment member is independent of adjustment of the arcuate slots 90 and 92, which determines the arcuate span of water distribution.

Figure 6:
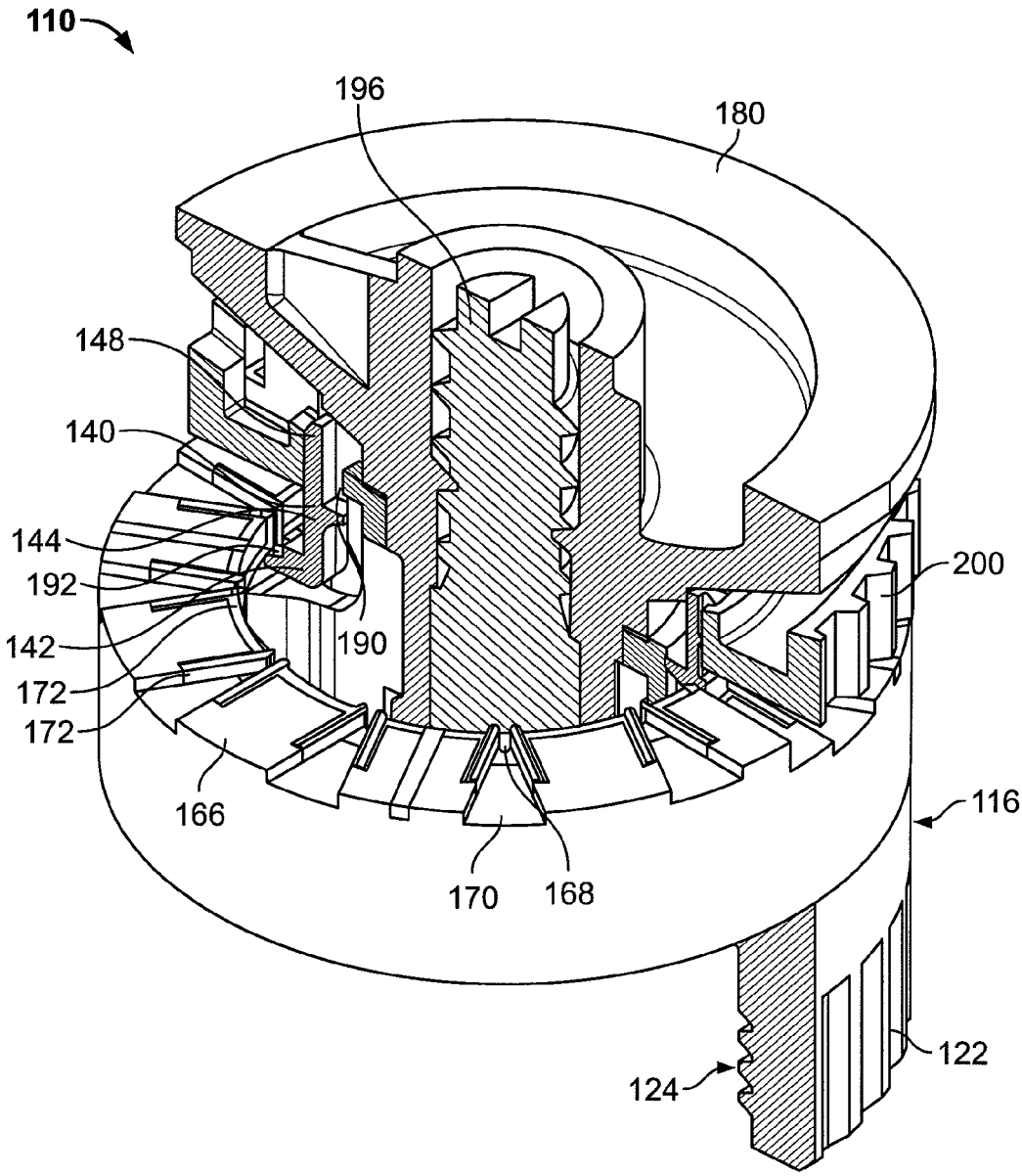
FIG. 6 is a partially cut away perspective view of a second embodiment of a variable arc nozzle embodying features of the present invention to provide increased water distribution near the nozzle.

A second embodiment of the nozzle 110 is shown in FIG. 6. The second embodiment functions essentially in the same manner as described above for the first embodiment. The second embodiment includes generally a nozzle body 116 (which includes a collar 140), a deflector 180, and an adjustment ring 200. In the second embodiment, the nozzle body 116 includes two sonically welded pieces, rather than the base 20 and cover 60 of the first embodiment. This second embodiment saves on tooling and assembly costs.

As shown in FIG. 6, the nozzle body 116 has a lower end 122 with internal threading 124 for mounting onto a riser. The nozzle body 116 also has a ring-like central hub 166 that includes grooves 168 spaced along the inside circumference of the central hub 166 and extending generally vertically to triangular flow passages 170 spaced circumferentially about the central hub 166. The triangular flow passages 170 are preferably reinforced with elastomer seal portions 172 between and along the flow passages 170 to prevent leakage.

Figure 7:
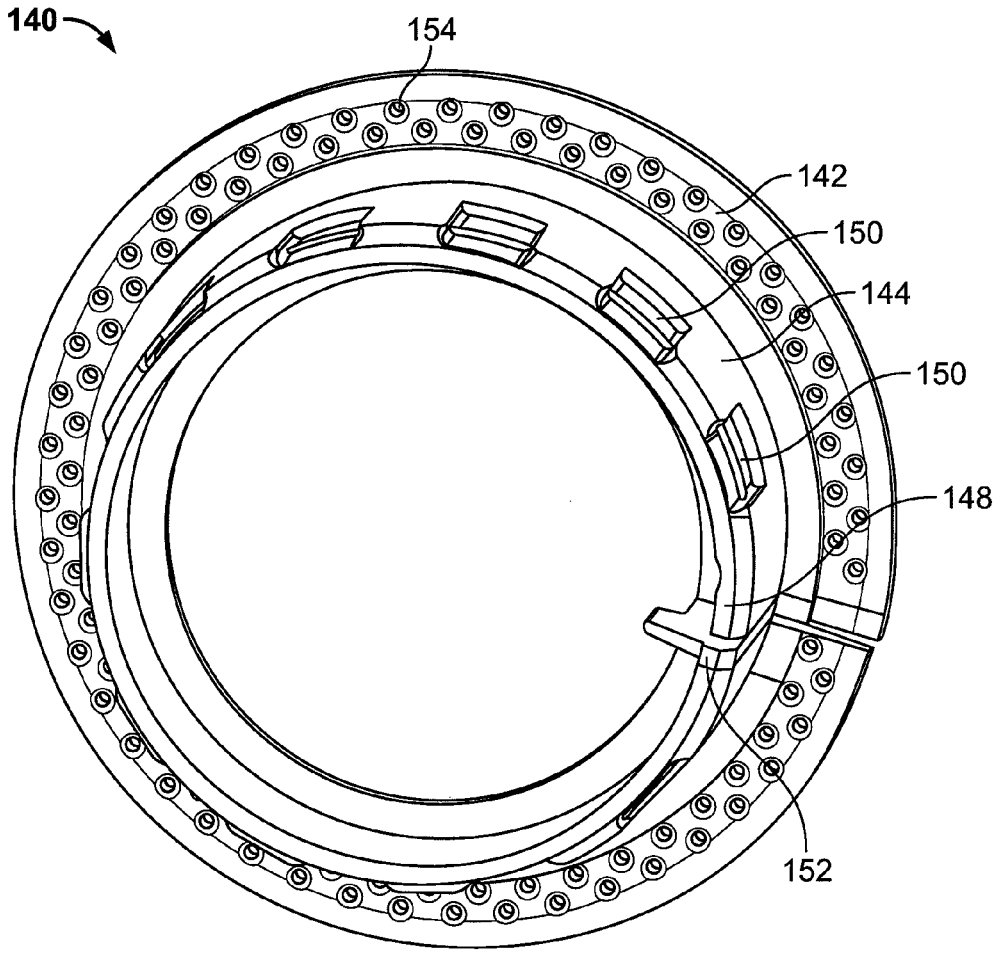
FIG. 7 is a perspective view of the collar of the variable arc nozzle of FIG. 6.

The collar 140 of the second embodiment is shown in FIG. 7. The collar 140 includes a central hub 144 having an upper edge 148 that defines a spiral with axially offset ends and includes a ring-like flange 142 that defines a spiral with axially offset ends. The upper edge 148 helically engages the underside of a deflector 180 to form an upper arcuate slot 190, and the ring-like flange 142 helically engages the nozzle body 116 to form a lower arcuate slot 192. The collar 140 also includes a stop 152 to prevent over-rotation of the collar 140 and a splined surface 150 to interlockably engage adjustment ring 200.

As shown in FIG. 7, the collar 140 is perforated with small holes 154, preferably about 0.01 inches in diameter, to filter water flowing in the second flow path through the lower arcuate slot 192. This filtering mechanism is an alternative to the teeth 54 used in the first embodiment, as shown in FIG. 2, and may also be used with other embodiments.

The spiral surfaces of the second embodiment provide two flow paths through the upper and lower arcuate slots 190 and 192 to distribute water relatively distant from and relatively close to the nozzle 110. For instance, in FIG. 6, the upper and lower arcuate slots 190 and 192 are shown open on the left side of the figure and closed on the right side. The second embodiment also preferably includes an adjustment ring 200 for rotating the collar 140 and an adjustment screw 196 for adjusting the throw radius of the nozzle 110.

Figure 8:
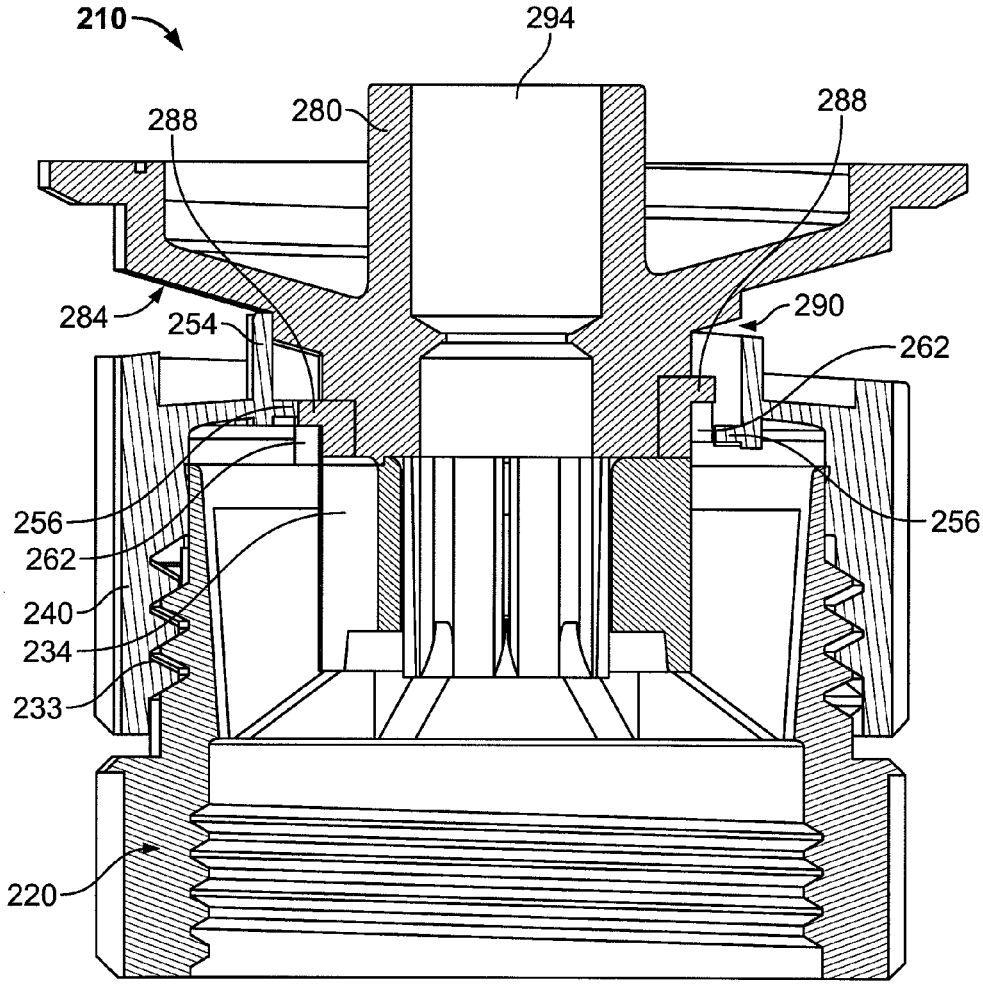
FIG. 8 is a cross-sectional view of a third embodiment of a variable arc nozzle embodying features of the present invention to provide an improved uniform precipitation rate.
Figure 9:
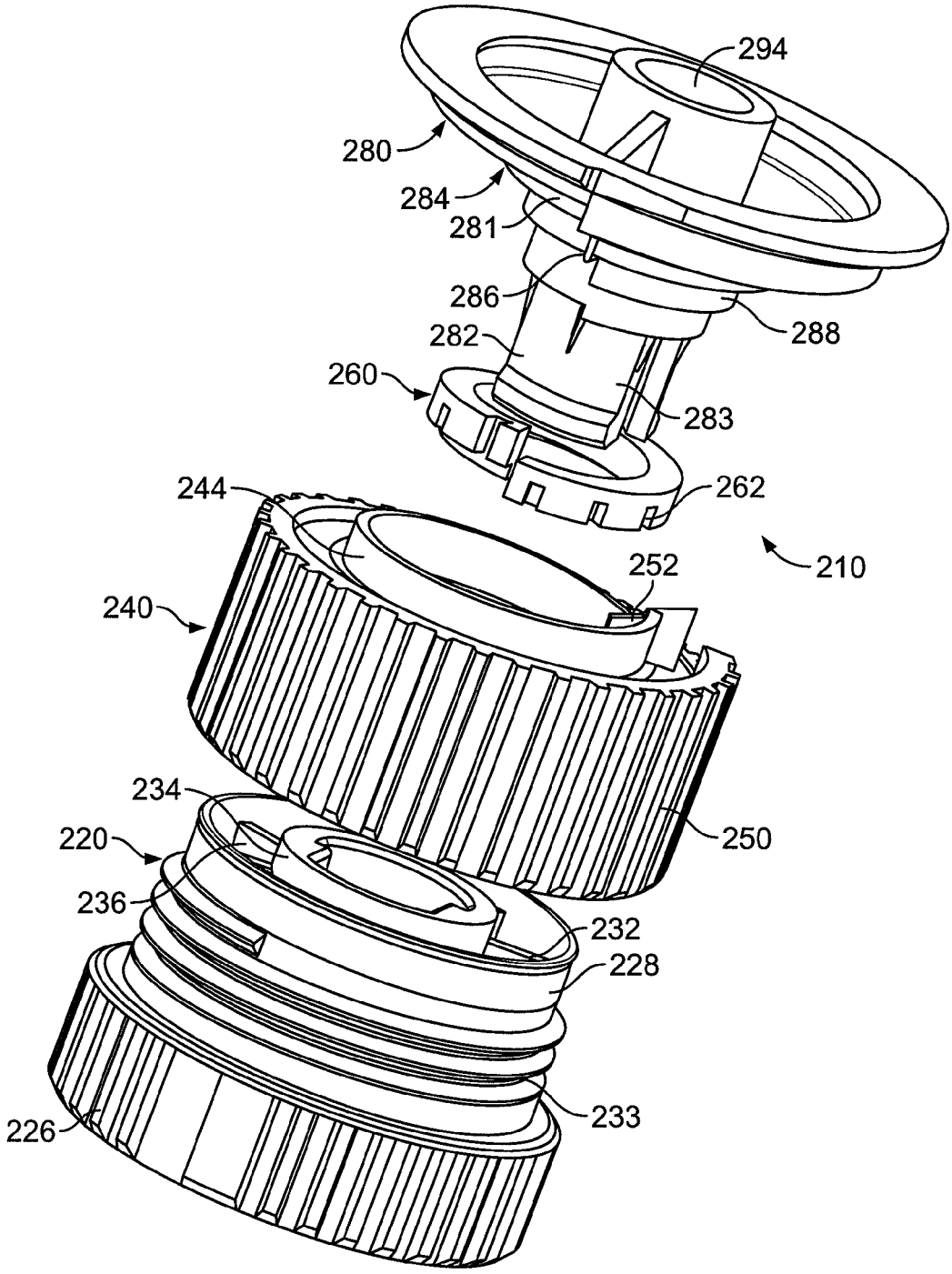
FIG. 9 is an exploded perspective view of the variable arc nozzle of FIG. 8.

A third embodiment of the nozzle 210 is shown in FIGS. 8 and 9. This nozzle 210 preferably maintains a relatively constant water precipitation regardless of the extent of the arcuate span. More specifically, for a given nozzle design and intended radius of coverage, the nozzle 210 maintains a fairly even precipitation rate, i.e., water per area, regardless of the arcuate span of water distribution. Thus, when the arcuate span is large, the flow rate is relatively high, and when the arcuate span is decreased, the flow rate is decreased. This "matched precipitation rate" feature allows for the maintaining of a fairly constant precipitation rate, regardless of the arcuate span selected by the user.

The nozzle 210 preferably includes a base 220, a collar 240, a split ring 260, and a deflector 280. Each of the components preferably includes spiral surfaces for engaging one or more other components to allow adjustability of the arcuate span. The matched precipitation rate is provided by the introduction of one or more notches 262 on the split ring 260 into the flow path of water exiting the nozzle 210. Each notch 262 opens downward and radially outward.

As shown in FIG. 9, the base 220 is generally cylindrical in shape with internal threading for mounting onto a riser. The base 220 includes a grippable external surface 226 to assist in mounting. The base 220 also includes external threading 233 for threading engagement with the collar 240. As shown in FIG. 9, the base 220 includes a set of spoke-like ribs 232 that interconnect the outer wall 228 of the base 220 to the central hub 234. These spoke-like ribs 232 define flow passages 236 that permit water flow through the base 220.

Figure 10:
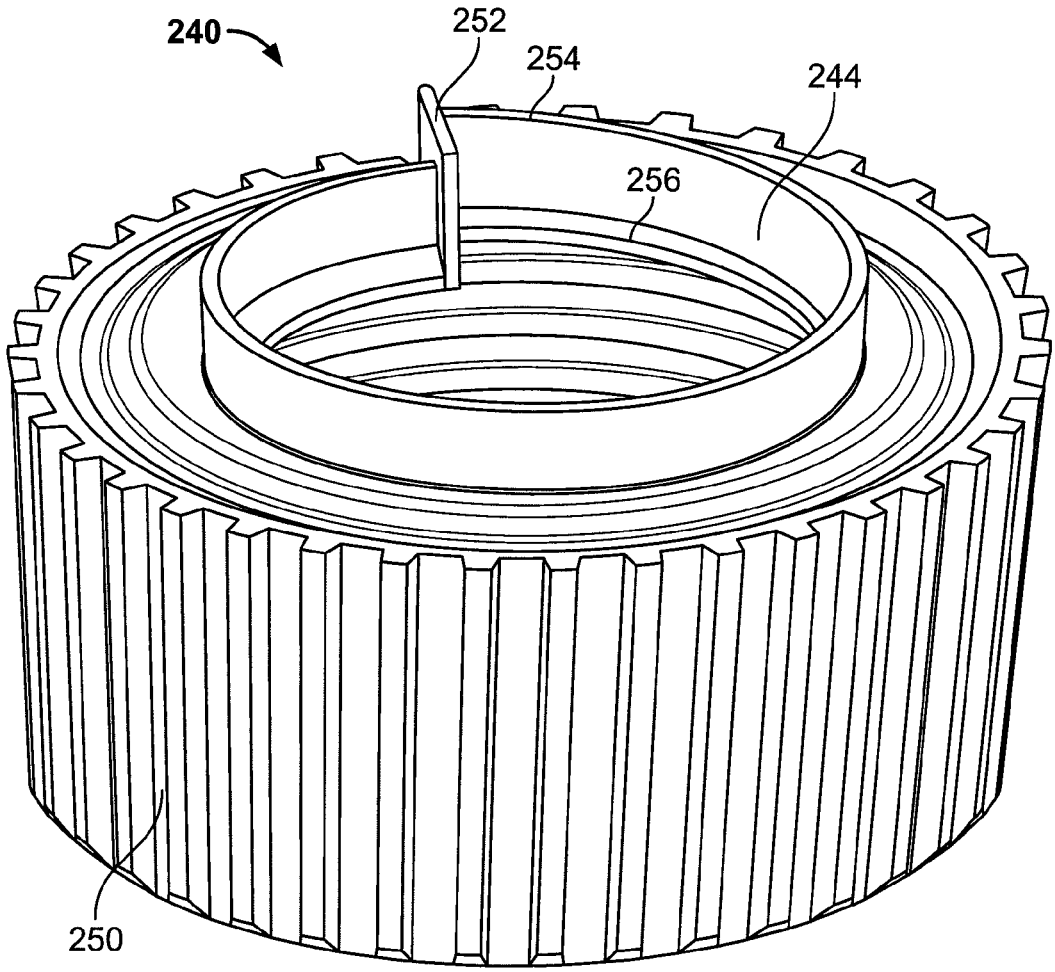
FIG. 10 is a perspective view of the collar of the variable arc nozzle of FIG. 8.

As shown in FIGS. 9 and 10, the collar 240 is also generally cylindrical in shape and has complementary internal threading to allow the collar 240 to be threadedly mounted onto the base 220. The collar 240 includes a central hub 244 that defines an opening therethrough. The collar 240 and deflector 280 engage one another, as described further below, to allow variable arc water distribution by the nozzle 210. Further, the collar 240 and split ring 260 preferably engage one another to control the flow of water to the deflector 280, as described further below. The collar 240 has a grippable outer wall 250 that may be rotated by a user to adjust the arcuate span of water distribution.

As shown in FIG. 10, the central hub 244 of the collar 240 has an internal spiral rim 256 that defines approximately one 360 degree helical revolution, or turn, with axially offset ends. This internal spiral rim 256 preferably engages the helical ring 260. The central hub 244 extends upward to form a raised spiral edge 254, which also defines approximately one 360 degree helical revolution, or turn, with axially offset ends. The raised spiral edge 254 engages a corresponding spiral underside surface 284 of the deflector 280.

As shown in FIG. 9, the deflector 280 has a generally frusto-conical shape with an enlarged head portion 281 and a lower stem portion 283 that extends into two prongs 282, similar to the deflector 80 described above and shown in FIG. 2. During assembly, the prongs 282 of the deflector 280 are inserted through the central hub 244 of the collar 240 and lock with the central hub 234 of the base 220. The nozzle base 220 and the deflector 280 are thereby fixed with respect to one another. The collar 240, however, is rotatable with respect to the base 220 and the deflector 280.

As shown in FIG. 9, the deflector 280 has a spiral underside surface 284 that engages the raised spiral edge 254 of the collar 240. The spiral underside surface 284 defines approximately one 360 degree helical turn, or revolution, where the ends of the helical turn are axially offset and joined by a stop 286. The collar 240 may be rotated through approximately one 360 degree helical turn with respect to the deflector 280 with a stop 252 of the collar 240 engaging the stop 286 of the deflector 280 to prevent further rotation. Further, the nozzle 210 preferably includes a bore 294 to permit use of an adjustment member to control a flow rate adjustment device.

The adjustment of the arcuate span is similar to that described above for the first and second embodiments. The raised spiral edge 254 of the collar 240 and the underside surface 284 of the deflector 280 engage one another to define the arcuate extent of the slot 290, which determines the arcuate span of water distribution. More specifically, the arcuate span is determined by the position of the raised spiral edge 254 of the collar 240 relative to the complementary helical underside surface 284 of the deflector 280. FIG. 8 shows the arcuate slot 290 closed on the left and open on the right of the figure. Unlike the first two embodiments shown in FIGS. 1-7, the nozzle 210, as shown in FIGS. 8 and 9, does not include a lower arcuate slot, but may be modified to include a lower arcuate slot for close in water distribution.

The matched precipitation rate results from the use of the split ring 260 that inter-fits with the collar 240 and the deflector 280. More specifically, as shown in FIG. 8, the split ring 260 engages a spiral edge 288 of the deflector 280 in the flow path beneath the arcuate slot 290. The spiral edge 288 and the split ring 260 define approximately a 360 degree spiral, or helical turn or revolution. As seen on the left side of FIG. 8, the spiral edge 288 of the deflector 280 contacts the internal spiral rim 256 of the collar 240 above the top of the notches 262, thereby blocking the flow path. In contrast, as seen on the right side of FIG. 8, the internal spiral rim 256 is spaced below the top of the notches 262, thereby allowing proportional water flow through exposed notches 262 (described in greater detail below) of the split ring 260 to the arcuate slot 290.

As seen in FIG. 9, the split ring 260 includes a series of spaced notches 262 disposed along its length and through which water must flow from the collar 240 to the deflector 280 for distribution to a selected arcuate area. As the collar 240 is rotated to select the arc, the number of notches 262 in the flow path changes. As the arc is increased, a greater number of notches 262 are disposed in the flow path, and conversely, if the arc is decreased, fewer notches 262 lie in the flow path. In this way, a matched precipitation rate can be achieved by proportioning the flow through the deflector 280, in accordance with the extent of the arcuate span.

The width and number of the notches 262 may be varied according to filtering requirements and flow demands. The width of the notches 262 is preferably sized greater than the filter size, which is preferably on the order of 0.02 inches, to avoid blockage of the notches 262. The number of notches 262 is preferably varied to accommodate the flow demand of nozzles designed for different throw radiuses with the number of notches 262 increasing as the intended throw radius increases. For example, a nozzle 210 may have 10 notches for an 8 foot radius of throw, 15 notches for a 10 foot radius of throw, 22 notches for a 12 foot radius of throw, and a continuous slot for a 15 foot radius of throw.

Initially, pressurized water flows from a source and through the flow passages 236 of the base 220. The water then flows through exposed notches 262 of the split ring 260, the number of exposed notches 262 depending on the extent of the arcuate span selected. The water then flows through the arcuate slot 290 and impacts the underside 284 of the deflector 280, which redirects the water to desired terrain at a predetermined distance about the nozzle 210.

Figure 11:
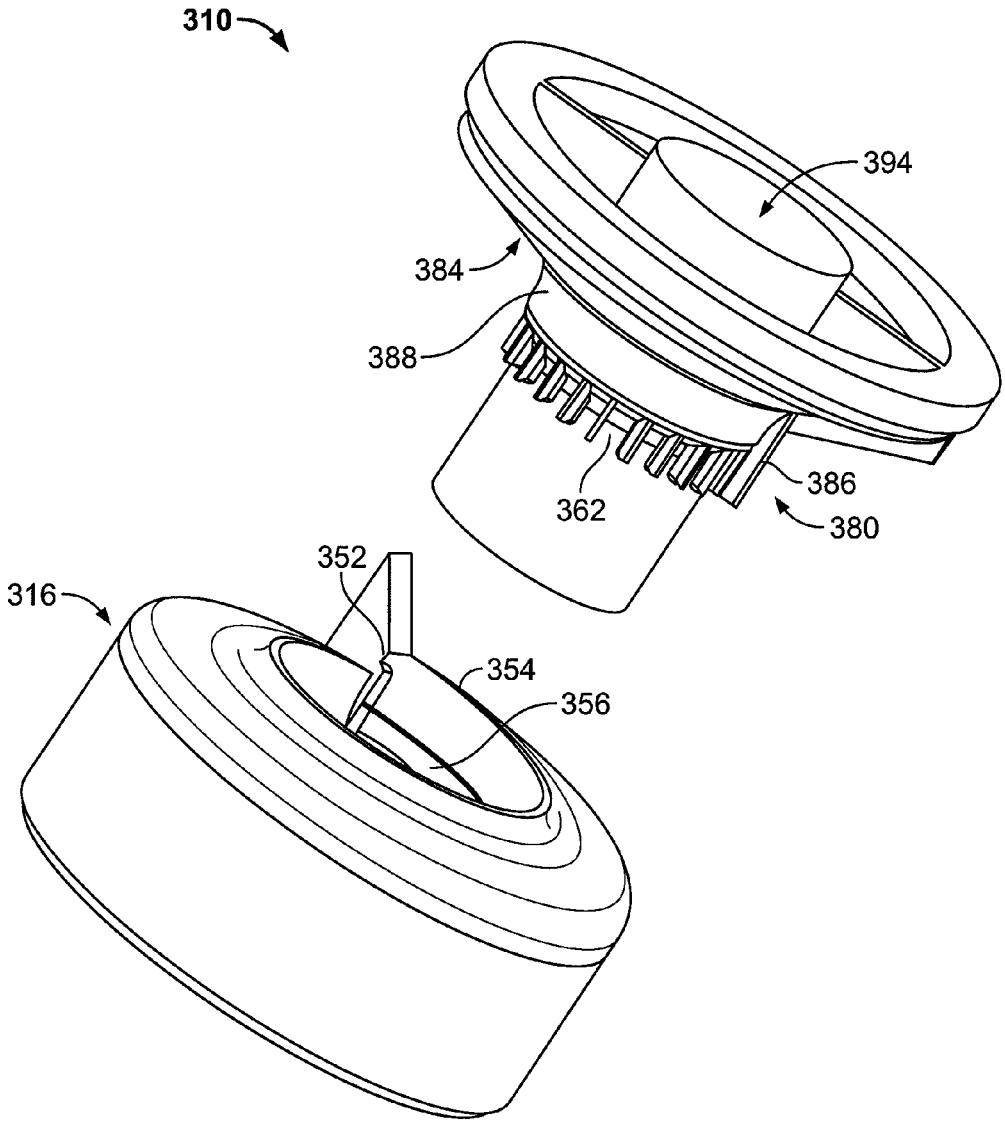
FIG. 11 is an exploded perspective view of a fourth embodiment of a variable arc nozzle embodying features of the present invention to provide an improved uniform precipitation rate.
Figure 12:
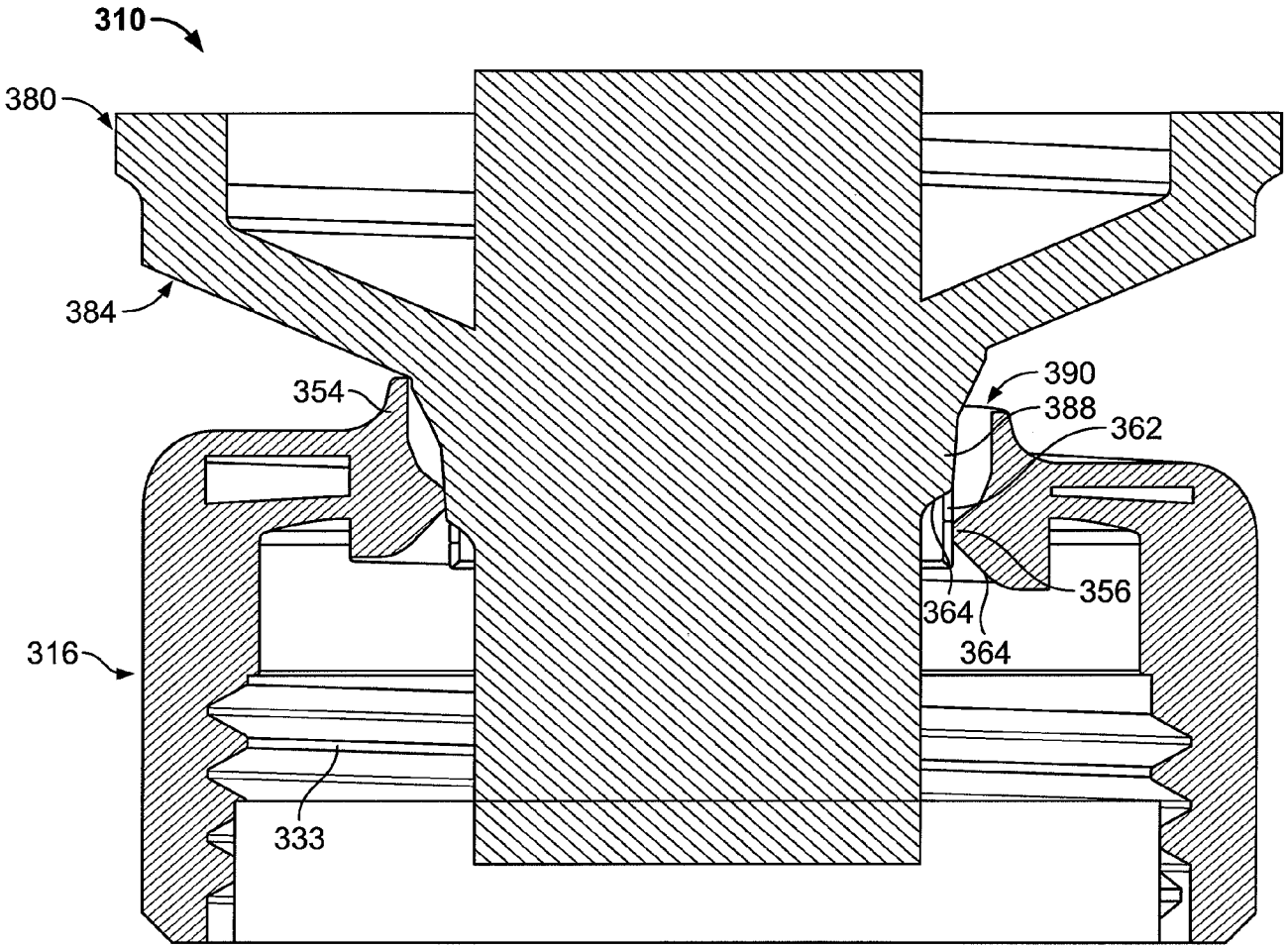
FIG. 12 is a cross-sectional view of the variable arc nozzle of FIG. 11.

FIGS. 11 and 12 depict a fourth embodiment of the variable arc nozzle 310 that also provides a matched precipitation rate. The fourth embodiment does not use a separate split ring 260. Instead, the deflector 380 has an integral series of spaced notches 362 molded into the deflector 380 with the notches 362 disposed in a spiral beneath a spiral edge 388 of the deflector 380. This molding saves cost and simplifies assembly by eliminating the need for separate and additional pieces. As should be evident, the matched precipitation rate features of the third and fourth embodiments, such as the split ring 260 and notches 362, may also be used in other embodiments described herein.

The fourth embodiment operates in essentially the same manner as described above for the third embodiment to restrict flow and maintain a relatively constant precipitation rate. The nozzle body 316 includes internal threading 333 for mounting onto a base, such as the base 220 shown in FIG. 9. The nozzle body 316 is rotatable with respect to the deflector 380 until a stop 352 on the nozzle body 316 engages a stop 386 on the deflector 380. The nozzle body 316 includes a raised spiral edge 354 that engages the helical underside surface 384 of the deflector 380 to define an arcuate slot 390. The nozzle body 316 also includes an internal spiral rim 356 for helical engagement with notches 362 to proportion the flow through the deflector 380. In addition, as shown in FIG. 11, the deflector 380 preferably includes a bore 394 to accommodate an adjustment member for setting a flow rate adjustment device.

Pressurized water flows from a source through the nozzle body 316. Water then flows through exposed notches 362, the number of exposed notches 362 depending on the extent of the arcuate span selected by the user. As the nozzle body 316 is rotated to select the arcuate span, the number of exposed notches 362 either increases or decreases, thereby proportioning the flow. After passing through the notches 362, the water flows through an arcuate slot 390 and impacts the underside 384 of the deflector 380, which redirects the water to terrain at a predetermined distance about the nozzle 310. In the fourth embodiment, the nozzle body 316 and the deflector 380 have been designed to minimize the loss of water velocity and energy as water flows through the flow path. More specifically, the deflector 380 and nozzle body 316 have rounded surfaces 364 to reduce velocity and energy dissipation as water impacts and is redirected by these surfaces 364.

Figure 13:
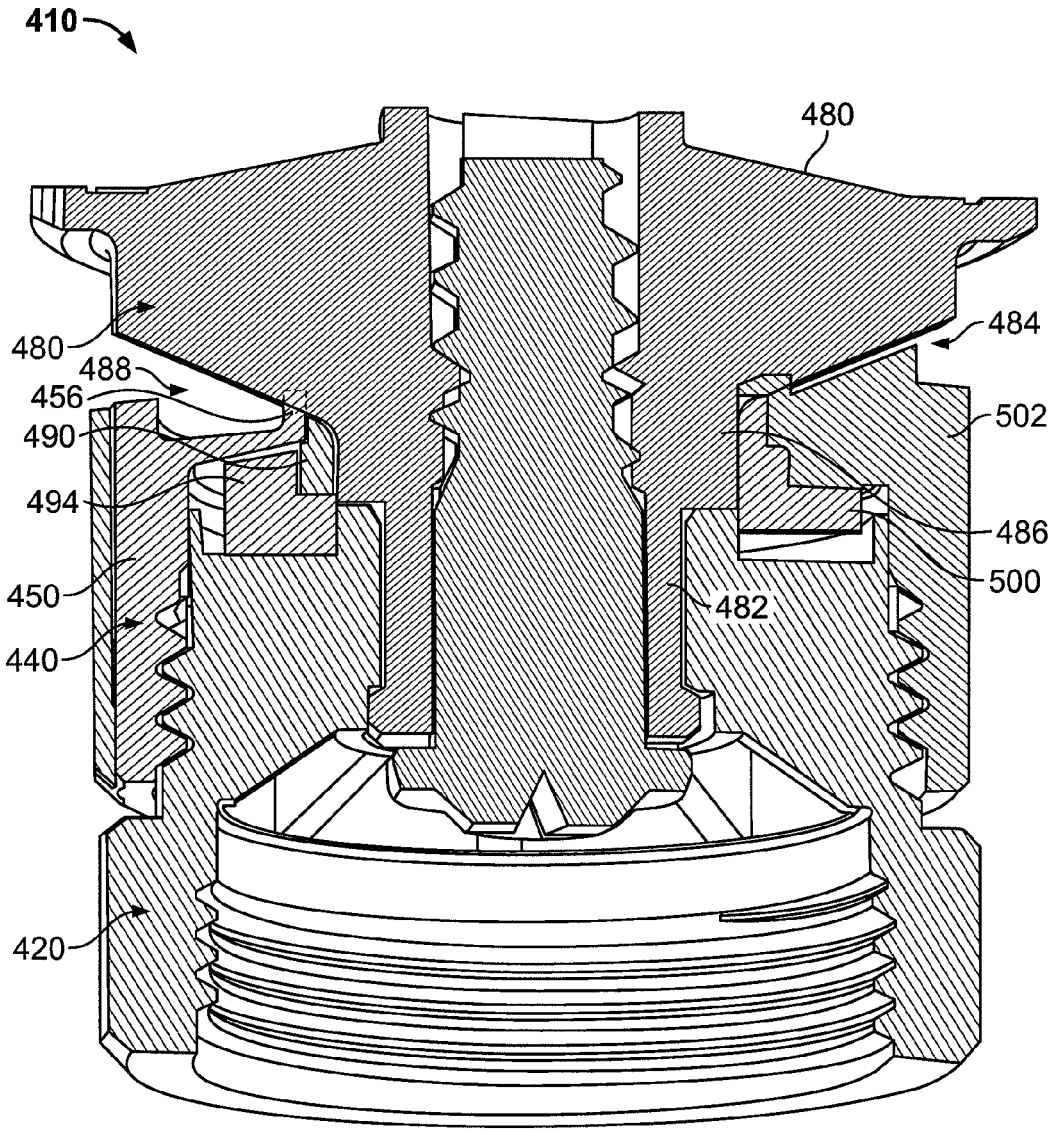
FIG. 13 is a cross-sectional view of a fifth embodiment of a variable arc nozzle embodying features of the present invention to improve water distribution at the edges of the water distribution arc.

FIG. 13 shows a fifth preferred embodiment of a nozzle 410. The nozzle 410 employs improved edge "fins" to enhance and create uniform water distribution at the edges of the arcuate span. The nozzle 410 includes a base 420, collar 440, and deflector 480. As with other embodiments, the collar 440 and the deflector 480 have spiral surfaces that engage one another for adjustably setting the arcuate span of the nozzle 410.

The base 420, collar 440, and deflector 480 also each include edge fins that result in more even water distribution at the edges of the arc. The edge fins collectively define the two edges of the arcuate span. More specifically, the edge fins on the base 420 and the deflector 480 cooperate to define the flow path for one edge of the water distribution arc, i.e., on the left of FIG. 13, while the edge fins on the collar 440 define the flow path for the second edge, i.e., on the right of FIG. 13.

Figure 14:
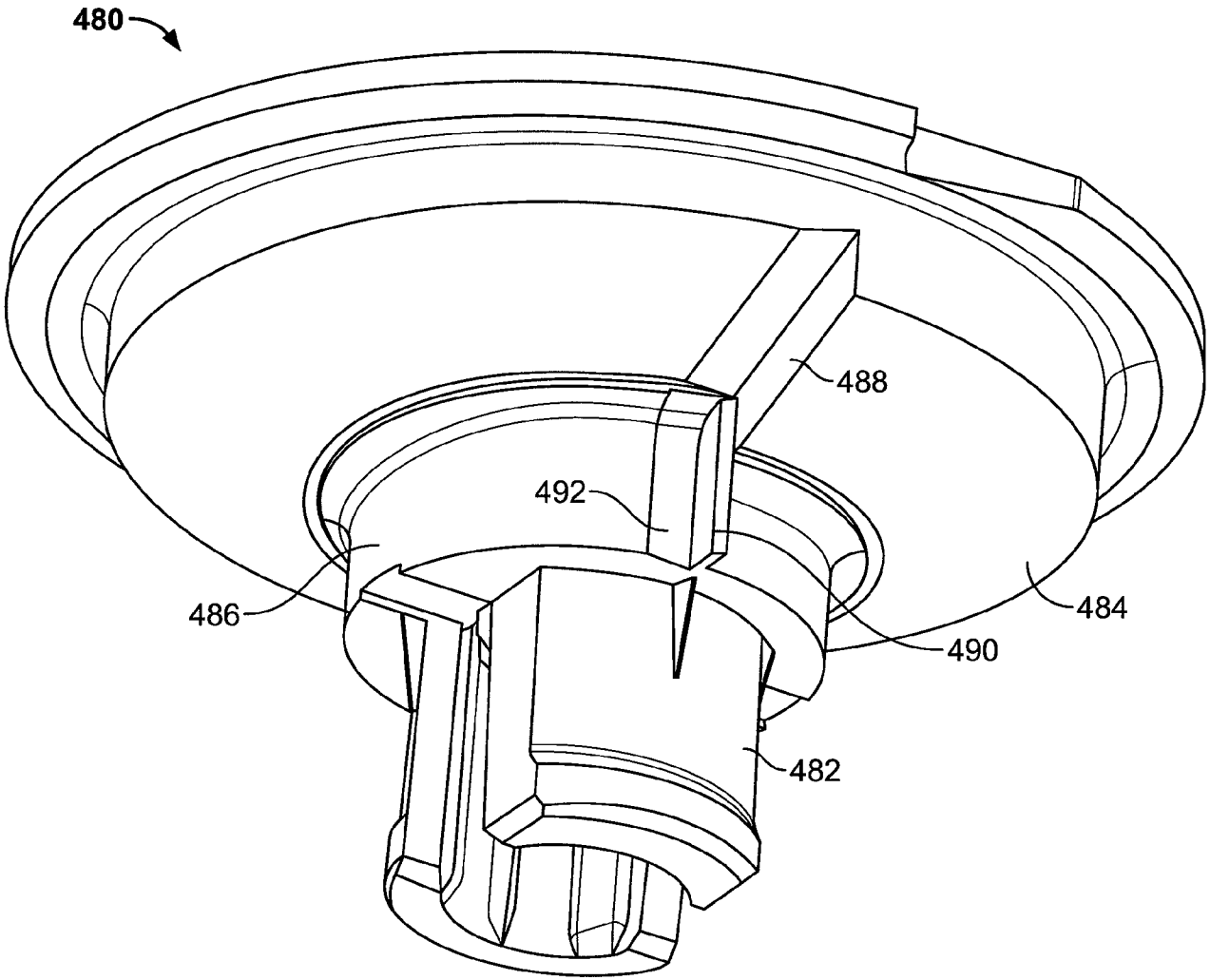
FIG. 14 is a perspective view of the deflector of the variable arc nozzle of FIG. 13.

One set of edge fins (the set shown on the left of FIG. 13) is located on, and is defined by, the deflector 480 and the base 420. As shown in FIG. 14, the deflector 480 has a spiral underside surface 484 that deflects water directed against it outward from the nozzle 410 and to desired terrain surrounding the nozzle 410. The deflector 480 also has two substantially concentric stem segments 482 and 486 extending longitudinally in series from the center of the spiral underside surface 484. The distal stem segment 482 preferably has two arcuate fingers that can be deflected toward one another for insertion into the base 420 and, once inserted, they bias outward in their static position to hold the deflector 480 in fixed engagement with the base 420. The proximate stem segment 486 is larger in diameter than the distal stem segment 482, lies between the spiral underside surface 484 and the distal stem segment 482, and engages the rotatable collar 440 to define the extent of the arcuate span of water distribution.

The deflector 480 has an upper edge fin 488 disposed on the spiral underside surface 484 and a lower edge fin 490 disposed on the proximate stem segment 486. As shown in FIG. 14, the upper deflector edge fin 488 extends between the inner circumference and outer circumference of the spiral underside surface 484. The lower deflector edge fin 490 extends vertically from the bottom to the top of the proximate stem segment 486.

Together, the upper edge fin 488 and the lower edge fin 490 project radially outwardly from deflector 480 to define part of one edge boundary of the arcuate span. These edge fins 488 and 490 are aligned end-to-end so as to define a relatively long axial boundary to channel the flow of water exiting the nozzle 410. More specifically, the edge fins 488 and 490 extend along the flow path from the flow passages 436 in the base 420 (FIG. 15) to the upper, outer circumference of the spiral underside surface 484. This long axial boundary reduces the tangential components of flow along the boundary formed by the edge fins 488 and 490, producing a well-defined edge to the arcuate span. In addition, the spiral underside surface 484 and proximate stem segment 486 preferably define a channel 492 extending along the length of, and adjacent to, the edge fins 488 and 490. This channel 492 further enhances and defines the first edge by columnating the water flow and by allowing an additional volume of flow along the first edge.

Figure 15:
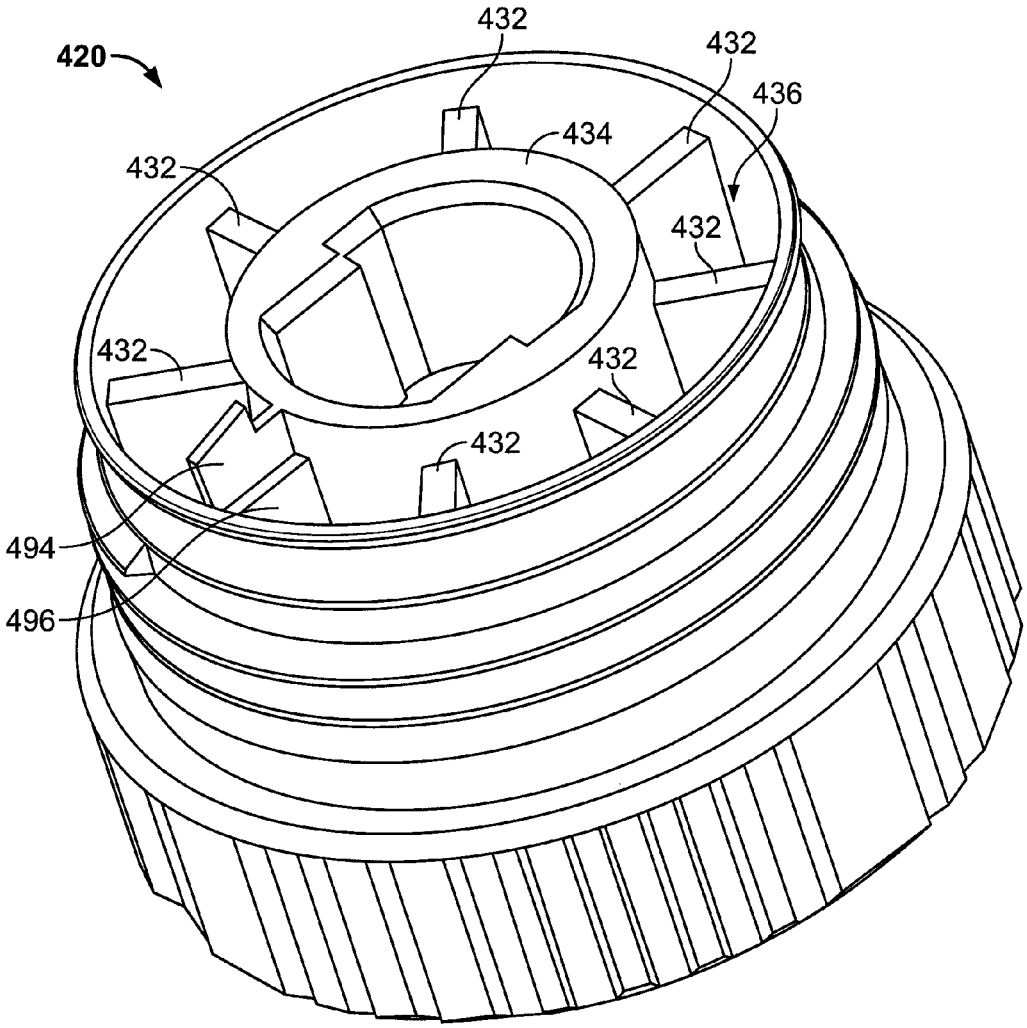
FIG. 15 is a perspective view of the base of the variable arc nozzle of FIG. 13.

This long axial boundary is further lengthened by a base edge fin 494 projecting upwardly from a rib 496 of the base 420 (FIGS. 13 and 15). The base edge fin 494 is preferably L-shaped and cooperates with the lower deflector edge fin 490 and with the underside of the collar 440, as illustrated in FIG. 13. The base edge fin 494 minimizes tangential flow between the rib 496 and the proximate stem segment 486. In effect, the base edge fin 494 extends the rib 496 and extends the axial boundary from the top of the rib 496 to the outer circumference of the spiral underside surface 484.

Also, as shown in FIGS. 13-15, the lower deflector edge fin 490 cooperates with the base edge fin 494 to extend the boundary edge in a radial direction (in addition to the axial direction). As shown in FIG. 14, the lower deflector edge fin 490 extends radially outwardly from the proximate stem segment 486. As shown in FIG. 15, the base edge fin 494 extends radially outwardly from the central hub 434 of the base 420 toward the outer wall 450 of the collar 440. The lower deflector edge fin 490 extends radially outwardly so that it preferably engages the internal spiral rim 456 of the collar 440 and so that it preferably engages the base edge fin 494 (FIG. 13). By extending the lower deflector edge fin 490 radially so that it engages the collar 440 and the base edge fin 494, water cannot leak into the gaps that would otherwise exist between the base 420, collar 440, and deflector 480. Water leaking into such gaps would otherwise provide a tangential flow component that would interfere with water exiting the nozzle 410. The lower deflector edge fin 490 and the base edge fin 494 therefore minimize this tangential component.

The second set of edge fins is located on the collar 440. The second set of edge fins defines the flow path for water exiting the nozzle 410 along the second edge, i.e., along the edge boundary shown in the right of FIG. 13. The edge fins on the collar 440 reduce the tangential component of water flow that interferes with water exiting the nozzle 410 along that second edge.

Figure 16:
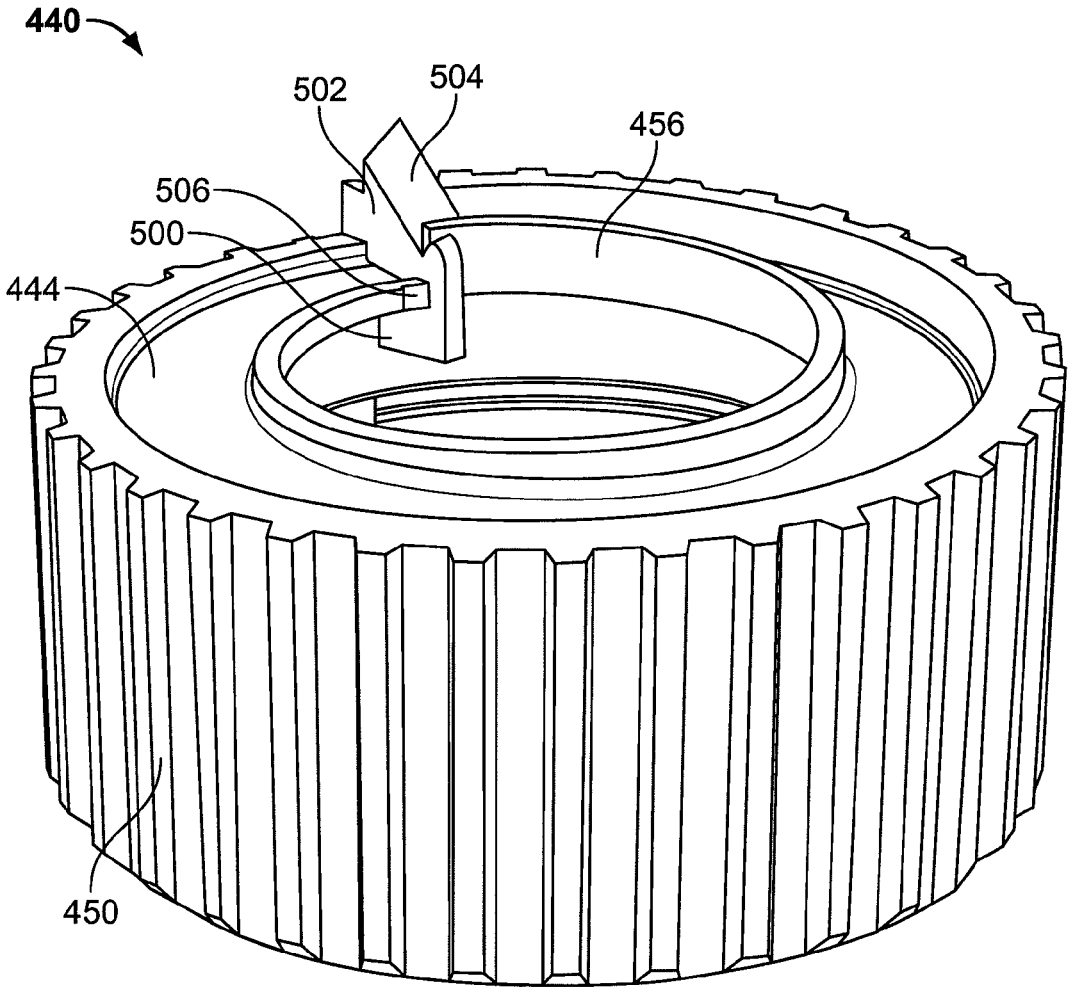
FIG. 16 is a top perspective view of the collar of the variable arc nozzle of FIG. 13.
Figure 17:
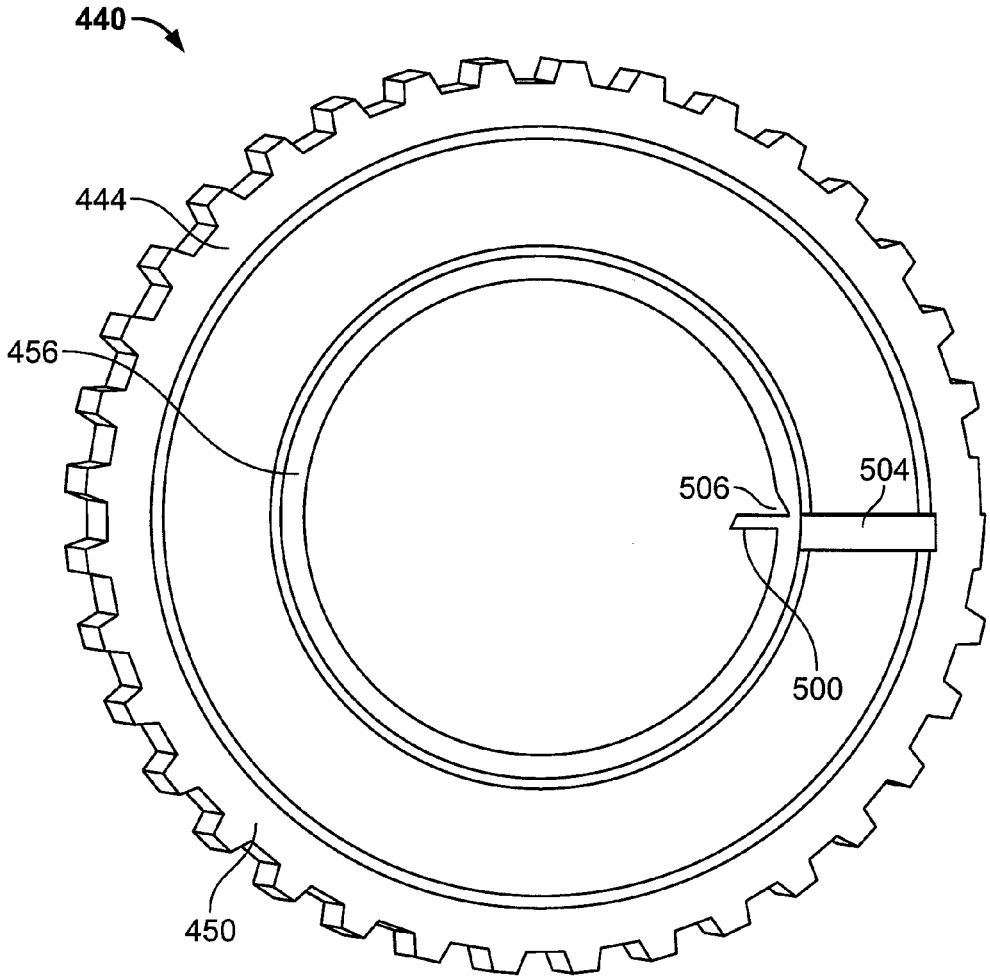
FIG. 17 is a top view of the collar of the variable arc nozzle of FIG. 13.

As shown in FIGS. 16 and 17, the collar 440 includes an annular central band 444 that defines an opening therethrough. The annular band 444 is encircled by the outer wall 450 that may be engaged by a user to be manually rotated to adjust the extent of the arcuate span. The internal rim 456 of the collar 440 defines a spiral for engagement with the deflector 480.

The collar edge fins include a first collar edge fin 500 located primarily on the underside of the annular band 444 that wraps around the annular band 444 and extends into a second collar edge fin 502 located on the top of the band 444. In other words, as shown in FIGS. 13 and 16, the first collar edge fin 500 projects downwardly from the underside of the band 444, extends from a point near the outer wall 450 of the collar 440 radially inwardly to engage the proximate stem segment 486 of the deflector 480, and extends upwardly along the proximate stem segment 486. The second collar edge fin 502 projects upwardly from the top of the band 444 and extends from the outer wall 450 radially inwardly to meet the first collar edge fin 500. The second collar edge fin 502 has an upper inclined surface 504 for engaging the spiral underside surface 484 of the deflector 480.

The first and second collar edge fins 500 and 502 extend the second boundary edge both axially and radially so that water flows upwardly along the collar edge. In the axial direction, the second boundary edge extends from just above the ribs 432 of the base 420 to the outer end of the second collar edge fin 502. In the radial direction, the first collar edge fin 500 extends the second boundary edge from the proximate stem segment 486 of the deflector 480 to a point near the outer wall 450 of the collar 440. In this manner, the first and second collar edge fins 500 and 502 reduce axial and radial bypass flow at the collar edge of the nozzle 410.

During operation, the base 420 and deflector 480 are fixed relative to the rotating collar 440. As shown in FIG. 13, the base, collar, and deflector edge fins are sized so as not to interfere with rotatable adjustment of the collar 440 to define the extent of the arcuate span. Also, the base, collar, and deflector edge fins can be used with other embodiments of the nozzle described herein.

The nozzle 410 is preferably assembled so that there is a tight interference fit to prevent radial bypass flow. More specifically, the nozzle 410 is assembled so that there is a tight interference fit between the lower deflector edge fin 490 and the internal spiral rim 456 of the collar 440. Also, the nozzle 410 is assembled so that that there is a tight interference fit between the first collar edge fin 500 and the proximate stem segment 486 of the deflector 480.

These interference fits are preferably accomplished through the use of the channel 492 adjacent to the lower deflector edge fin 490 (FIG. 14) and through the use of a notch 506 in the internal spiral rim 456 of the collar 440 (FIGS. 16 and 17). During assembly, the channel 492 provides sufficient clearance for the inwardly projecting first collar edge fin 500. Similarly, during assembly, the notch 506 provides sufficient clearance for the outwardly projecting lower deflector edge fin 490. Upon rotation, the channel 492 and notch 506 allow the deflector 480 and the collar 440 to gradually deform these respective fins 500 and 490 into their sealing positions.

The foregoing relates to preferred exemplary embodiments of the invention. It is understood that other embodiments and variants are possible which lie within the spirit and scope of the invention as set forth in the following claims.

What is claimed is:

1. A variable arc sprinkler nozzle comprising:

a deflector having an underside surface contoured to deliver fluid and defining a portion of a helix;

a nozzle body having an upper surface defining a portion of a helix for rotatably engaging the helical underside surface of the deflector to form a first arcuate slot that is adjustable in size, the nozzle body defining an inlet, a first outlet, and a second outlet, wherein the inlet is capable of receiving fluid from a source, the first outlet is capable of delivering fluid to the underside surface of the deflector, and the second outlet is capable of delivering fluid generally radially outwardly from the nozzle body;

a first fluid flow path extending from the inlet to the first arcuate slot to the underside surface of the deflector for delivering fluid generally radially outwardly from the deflector through a first arcuate span; and a second fluid flow path extending between the inlet and the second outlet for delivering fluid generally radially outwardly from the second outlet through a second arcuate span.

2. The variable arc sprinkler nozzle of claim 1 wherein said second arcuate span is substantially coincident with said first arcuate span.

3. The variable arc sprinkler nozzle of claim 1 wherein the first outlet comprises the first arcuate slot.

4. The variable arc sprinkler nozzle of claim 1 wherein at least a portion of the nozzle body is rotatable through approximately 360 degrees when the nozzle body is in helical engagement with the deflector, rotation causing the upper surface of the nozzle body to traverse the helical underside surface of the deflector.

5. The variable arc sprinkler nozzle of claim 4 wherein the at least a portion of the nozzle body is rotatable in a clockwise or counterclockwise direction to increase or decrease the size of the first arcuate slot to allow fluid distribution in a desired arc within the range from about 0 degrees to 360 degrees.

6. The variable arc sprinkler nozzle of claim 5 wherein the nozzle body defines a second arcuate slot situated in the second fluid flow path that is adjustable in size to distribute water in the second arcuate span.

7. The variable arc sprinkler nozzle of claim 6 wherein the second arcuate slot is coupled to the first arcuate slot by the rotatable portion of the nozzle body such that the first arcuate span is substantially the same as the second arcuate span.

8. The variable arc sprinkler nozzle of claim 7 further comprising an adjustment ring that is coupled to the rotatable portion of the nozzle body and capable of causing rotation to increase or decrease the size of the first and second arcuate slots.

9. The variable arc sprinkler nozzle of claim 5 further comprising a matching precipitation rate device in the first fluid flow path that is adjustable to proportion the amount of fluid directed to the deflector depending on the size of the first arcuate span.

10. The variable arc sprinkler nozzle of claim 9 wherein the matching precipitation rate device comprises a split ring situated in the first fluid flow path and having a series of spaced notches disposed along its length, rotation of the rotatable portion of the nozzle body exposing a greater or lesser number of notches in the first fluid flow path when the first arcuate span is increased or decreased.

11. The variable arc sprinkler nozzle of claim 9 wherein the deflector comprises a stem generally cylindrical in shape and the matching precipitation rate device comprises a series of notches spaced circumferentially about the stem, rotation of the rotatable portion of the nozzle body exposing a greater or lesser number of notches in the first fluid flow path when the first arcuate span is increased or decreased.

12. The variable arc sprinkler nozzle of claim 1 wherein the deflector includes a central hub defining a bore for insertion of a flow rate adjustment member therethrough.

13. The variable arc sprinkler nozzle of claim 1 further comprising one or more edge surfaces lying in the first fluid flow path and channeling fluid flow to define one or both edges of the first arcuate span.

14. The variable arc sprinkler nozzle of claim 13 wherein the deflector comprises a stem extending from the underside surface, the stem and underside surface of the deflector defining a deflector edge surface projecting outwardly therefrom, the deflector edge surface channeling fluid flow to define the first edge of the first arcuate span.

15. The variable arc sprinkler nozzle of claim 14 wherein the nozzle body includes a base, the base comprising a plurality of ribs defining flow passages, the base further comprising a base edge surface projecting upwardly from one of the plurality of ribs, the base edge surface cooperating with the deflector edge surface to channel fluid flow and define the first edge of the first arcuate span.

16. The variable arc sprinkler of claim 14 wherein the nozzle body comprises a collar rotatable with respect to the deflector, the collar including a collar edge surface extending upstream and radially inwardly from the collar for channeling fluid flow to define the second edge of the first arcuate span.

17. A variable arc sprinkler nozzle comprising:

a deflector having an underside surface contoured to deliver fluid and defining a portion of a helix;

a nozzle body comprising a base that defines an inlet;

a collar having an upper surface defining a portion of a helix for rotatably engaging the underside surface of the deflector to form a first arcuate slot that is adjustable in size and having a lower surface that defines a portion of a helix;

a cover having a central hub that defines a portion of a helix, the central hub of the cover helically engageable with the lower surface of the collar to form a second arcuate slot that is adjustable in size;

a first fluid flow path extending from the inlet to the first arcuate slot to the underside surface of the deflector for delivering fluid generally radially outwardly from the deflector through a first arcuate span; and a second fluid flow path extending between the inlet and the second outlet for delivering fluid generally radially outwardly from the second outlet through a second arcuate span.

18. The variable arc sprinkler nozzle of claim 17 wherein the base is generally cylindrical in shape, has a central hub that defines a bore extending therethrough, and has one or more flow passages about the central hub.

19. The variable arc sprinkler nozzle of claim 18 wherein the deflector includes an end for insertion into the bore of the base to hold the deflector fixed with respect to the base.

20. The variable arc sprinkler nozzle of claim 17 wherein the lower surface of the collar includes a filter.

21. The variable arc sprinkler nozzle of claim 19 wherein the cover is generally cylindrical in shape and is engaged to the base to hold the cover fixed with respect to the base and to the deflector.

22. The variable arc sprinkler nozzle of claim 21 wherein the central hub of the cover is shaped like a ring and has a top surface, the central hub having grooves spaced circumferentially about the inside circumference of the central hub and having recesses defining flow passages spaced circumferentially about the top surface of the central hub.

23. The variable arc sprinkler nozzle of claim 22 wherein the second fluid flow path extends from the inlet of the base, through the one or more flow passages of the base, through the second arcuate slot, through the grooves of the cover, and generally radially outward through the flow passages of the cover.

24. The variable arc sprinkler nozzle of claim 17 further comprising an adjustment ring having a splined internal circumference for interlockably engaging with the collar and causing the collar to rotate to increase or decrease the size of the first and second arcuate slots.

25. The variable arc sprinkler nozzle of claim 17 further comprising a matching precipitation rate device in the first fluid flow path that is adjustable to proportion the amount of fluid directed to the deflector depending on the size of the first arcuate span.

26. The variable arc sprinkler nozzle of claim 25 wherein the matching precipitation rate device comprises a split ring situated in the first fluid flow path and having a series of spaced notches disposed along its length, rotation of the collar exposing a greater or lesser number of notches in the first fluid flow path when the first arcuate span is increased or decreased.

27. The variable arc sprinkler nozzle of claim 25 wherein the deflector comprises a stem generally cylindrical in shape and the matching precipitation rate device comprises a series of notches spaced circumferentially about the stem, rotation of the collar exposing a greater or lesser number of notches in the first fluid flow path when the first arcuate span is increased or decreased.

28. The variable arc sprinkler nozzle of claim 17 further comprising one or more edge surfaces lying in the first fluid flow path and channeling fluid flow to define one or both edges of the first arcuate span.

29. The variable arc sprinkler nozzle of claim 28 wherein the deflector comprises a stem extending from the underside surface, the stem and underside surface of the deflector defining a deflector edge surface projecting outwardly therefrom, the deflector edge surface channeling fluid flow to define the first edge of the first arcuate span.

30. The variable arc sprinkler nozzle of claim 29 wherein the base comprises a plurality of ribs defining flow passages, the base further comprising a base edge surface projecting upwardly from one of the plurality of ribs, the base edge surface cooperating with the deflector edge surface to channel fluid flow and define the first edge of the first arcuate span.

31. The variable arc sprinkler of claim 29 wherein the collar includes a collar edge surface extending upstream and radially inwardly from the collar for channeling fluid flow to define the second edge of the first arcuate span.

32. A variable arc sprinkler nozzle comprising:

a deflector having an underside surface contoured to deliver fluid and defining a portion of a helix;

a nozzle body having an upper surface defining a portion of a helix for rotatably engaging the helical underside surface of the deflector to form an arcuate slot that is adjustable in size, the nozzle body defining an inlet and an outlet wherein the inlet is capable of receiving fluid from a source and the outlet is capable of delivering fluid to the deflector through the arcuate slot, the arcuate slot capable of being set to an arcuate span;

a flow path from the inlet through the nozzle body and through the arcuate slot to the underside surface of the deflector; and a matching precipitation rate device in the flow path that is adjustable to proportion the amount of fluid directed to the deflector depending on the size of the arcuate span of the arcuate slot;

wherein at least a portion of the nozzle body is rotatable through approximately 360 degrees when the nozzle body is in helical engagement with the deflector, rotation causing the upper surface of the nozzle body to traverse the helical underside surface of the deflector;

wherein the at least a portion of the nozzle body is rotatable in a clockwise or counterclockwise direction to increase or decrease the size of the arcuate slot to allow fluid distribution in a desired arc within the range from about 0 degrees to 360 degrees;

wherein the deflector comprises a stem that is generally cylindrical in shape and a frusto-conical portion defining the helical underside surface;

wherein the matching precipitation rate device comprises a split ring having a series of spaced notches disposed along its length, rotation of the rotatable portion of the nozzle body exposing a greater or lesser number of notches in the flow path when the arcuate span is increased or decreased.

33. The variable arc sprinkler nozzle of claim 32 wherein the deflector further comprises a raised edge between the stem and frusto-conical portion, the raised edge defining a portion of a helix and coupled to and engaging the split ring.

34. The variable arc sprinkler nozzle of claim 33 wherein the nozzle body includes a central hub shaped like a ring and having an internal rim about the inside circumference of the central hub, the internal rim defining a portion of a helix for rotatably engaging the split ring.

35. A variable arc sprinkler nozzle comprising:

a deflector having an underside surface contoured to deliver fluid and defining a portion of a helix;

a nozzle body having an upper surface defining a portion of a helix for rotatably engaging the helical underside surface of the deflector to form an arcuate slot that is adjustable in size, the nozzle body defining an inlet and an outlet wherein the inlet is capable of receiving fluid from a source and the outlet is capable of delivering fluid to the deflector through the arcuate slot, the arcuate slot capable of being set to an arcuate span;

a flow path from the inlet through the nozzle body and through the arcuate slot to the underside surface of the deflector; and a matching precipitation rate device in the flow path that is adjustable to proportion the amount of fluid directed to the deflector depending on the size of the arcuate span of the arcuate slot;

wherein at least a portion of the nozzle body is rotatable through approximately 360 degrees when the nozzle body is in helical engagement with the deflector, rotation causing the upper surface of the nozzle body to traverse the helical underside surface of the deflector;

wherein the at least a portion of the nozzle body is rotatable in a clockwise or counterclockwise direction to increase or decrease the size of the arcuate slot to allow fluid distribution in a desired arc within the range from about 0 degrees to 360 degrees;

wherein the deflector comprises a stem that is generally cylindrical in shape and a frusto-conical portion defining the helical underside surface;

wherein the matching precipitation rate device comprises a series of notches spaced circumferentially about the stem of the deflector, rotation of the rotatable portion of the nozzle body exposing a greater or lesser number of notches in the flow path when the arcuate span is increased or decreased.

* * * * *